US012286798B2

(12) United States Patent
Giattina et al.

(10) Patent No.: US 12,286,798 B2
(45) Date of Patent: Apr. 29, 2025

(54) THREE AXIS CLIP SYSTEM FOR MOUNTING PANELS TO A WALL

(71) Applicant: BLOX, LLC, Bessemer, AL (US)

(72) Inventors: Chris Giattina, Bessemer, AL (US); John Easton, Bessemer, AL (US)

(73) Assignee: BLOX, LLC, Bessemer, AL (US)

( * ) Notice: Subject to any disclaimer, the term of this patent is extended or adjusted under 35 U.S.C. 154(b) by 126 days.

(21) Appl. No.: 18/213,972

(22) Filed: Jun. 26, 2023

(65) Prior Publication Data

US 2023/0417062 A1 Dec. 28, 2023

Related U.S. Application Data

(60) Provisional application No. 63/355,473, filed on Jun. 24, 2022.

(51) Int. Cl.
*E04F 13/08* (2006.01)

(52) U.S. Cl.
CPC ..... *E04F 13/0855* (2013.01)

(58) Field of Classification Search
CPC . E04F 13/0855; E04F 13/0808; E04F 13/083; E04F 13/0853; E04F 13/0816; E04B 2/88; E04B 2/90; E04B 2/96
See application file for complete search history.

(56) References Cited

U.S. PATENT DOCUMENTS 3,465,996 A * 9/1969 Von Wedel ..... E04B 2/94 52/235
3,913,287 A * 10/1975 Chapman, Jr. ..... E04B 5/06 52/235
4,070,835 A * 1/1978 Reverend ..... E04F 13/0808 52/235
4,483,122 A * 11/1984 Crandell ..... E04F 13/0808 52/235
4,561,228 A * 12/1985 Kaminaga ..... E04B 2/92 52/235

(Continued)

FOREIGN PATENT DOCUMENTS

CN 106013548 A * 10/2016
CN 106088516 A * 11/2016

(Continued)

OTHER PUBLICATIONS https://www.monarchmetal.com/products/monarch-z-clips, Monarch Z Clips, 14 pgs.

*Primary Examiner* — Ryan D Kwiecinski
(74) *Attorney, Agent, or Firm* — C. Brandon Browning; Maynard Nexsen PC

(57) ABSTRACT

The present disclosure is directed to a clip system and methods for using same for the attachment of finish panels to modular walls. The clip system includes a lower portion for attachment to the modular wall, an upper portion with a receptacle for attaching the panel, and a middle portion connecting the upper and lower portions. The middle portion further allows movement between portions so that the clip system can be expanded in two axial directions for precise panel placement. Further panels can be adjusted about the upper portion in a third axial direction. Thus, the clip system facilitates panel positioning and attachment in an exact, three-dimensional location on the modular wall.

20 Claims, 27 Drawing Sheets

(56) References Cited

U.S. PATENT DOCUMENTS

| | | | | | |
|---|---|---|---|---|---|
| 4,625,481 | A * | 12/1986 | Crandell | E04F 13/0808 | 52/235 |
| 4,817,352 | A * | 4/1989 | DeLange | G09F 15/0006 | 52/235 |
| 5,067,292 | A * | 11/1991 | Finean | E04F 13/0855 | 52/235 |
| 6,226,947 | B1 * | 5/2001 | Bado | E04F 13/0816 | 52/479 |
| 6,427,410 | B1 * | 8/2002 | Lind | E04F 13/083 | 52/511 |
| 6,748,709 | B1 * | 6/2004 | Sherman | E04B 2/96 | 52/235 |
| 7,716,891 | B2 * | 5/2010 | Radford | E04F 13/083 | 52/235 |
| 7,805,899 | B2 * | 10/2010 | Montgomery | E04F 13/083 | 52/235 |
| 8,555,577 | B2 * | 10/2013 | Maday | E04F 13/083 | 52/510 |
| 8,769,901 | B2 * | 7/2014 | Todd | E04B 1/7038 | 52/302.1 |
| 9,080,331 | B2 * | 7/2015 | Aboukhalil | E04F 13/0816 | |
| 10,041,256 | B2 * | 8/2018 | Scully | E04F 13/0807 | |
| 10,246,882 | B2 * | 4/2019 | Taing | E04F 13/081 | |
| 10,844,611 | B2 * | 11/2020 | Franklin | E04F 13/12 | |
| 12,054,954 | B2 * | 8/2024 | Houfflyn | E04F 13/083 | |
| 2007/0022682 | A1 * | 2/2007 | Morgenegg | E04B 2/90 | 52/235 |
| 2009/0272055 | A1 * | 11/2009 | Griffiths | E04F 13/0889 | 52/309.3 |
| 2009/0313932 | A1 * | 12/2009 | Montgomery | E04F 13/081 | 52/489.2 |
| 2012/0304573 | A1 * | 12/2012 | Aboukhalil | E04F 19/061 | 52/506.05 |
| 2013/0118107 | A1 * | 5/2013 | Maday | E04B 2/00 | 52/506.05 |
| 2013/0205698 | A1 * | 8/2013 | Todd | E04B 2/88 | 52/302.1 |
| 2013/0269276 | A1 * | 10/2013 | Gaynor | E04F 13/083 | 52/506.05 |
| 2014/0331598 | A1 * | 11/2014 | White | A47K 3/04 | 52/775 |
| 2015/0308123 | A1 * | 10/2015 | Prica | E04F 13/0889 | 52/483.1 |
| 2017/0130463 | A1 * | 5/2017 | Taing | E04F 13/083 | |
| 2019/0169855 | A1 * | 6/2019 | Czyz | E04F 13/0819 | |
| 2022/0034086 | A1 * | 2/2022 | Bunting | E04B 2/7403 | |
| 2023/0417062 | A1 * | 12/2023 | Giattina | E04F 13/083 | |
| 2024/0401340 | A1 * | 12/2024 | Plaschkes | E04F 13/083 | |

FOREIGN PATENT DOCUMENTS

| | | | | | |
|---|---|---|---|---|---|
| CN | 107013005 | A * | 8/2017 | E04F 13/0853 | |
| CN | 107013006 | A * | 8/2017 | E04F 13/0853 | |
| CN | 107035033 | A * | 8/2017 | E04B 2/88 | |
| CN | 107100339 | A * | 8/2017 | E04B 2/90 | |
| CN | 107143070 | A * | 9/2017 | E04B 2/88 | |
| CN | 107190940 | A * | 9/2017 | E04B 2/96 | |
| CN | 107447900 | A * | 12/2017 | | |
| CN | 108179853 | A * | 6/2018 | | |
| CN | 108678241 | A * | 10/2018 | E04B 2/88 | |
| CN | 108797930 | A * | 11/2018 | E04F 13/0801 | |
| CN | 109083317 | A * | 12/2018 | | |
| CN | 109457850 | A * | 3/2019 | E04B 2/96 | |
| CN | 109537782 | A * | 3/2019 | | |
| CN | 109610765 | A * | 4/2019 | E04F 13/0803 | |
| CN | 110541508 | A * | 12/2019 | | |
| CN | 110878603 | A * | 3/2020 | | |
| CN | 110952698 | A * | 4/2020 | | |
| CN | 111197392 | A * | 5/2020 | E04F 13/083 | |
| CN | 111287367 | A * | 6/2020 | E04B 2/96 | |
| CN | 111608355 | A * | 9/2020 | E04F 13/0801 | |
| CN | 111648508 | A * | 9/2020 | | |
| CN | 111927029 | A * | 11/2020 | E04F 13/0803 | |
| CN | 111997235 | A * | 11/2020 | | |
| CN | 112095948 | A * | 12/2020 | E04F 13/08 | |
| CN | 112267639 | A * | 1/2021 | E04F 13/0853 | |
| CN | 112554489 | A * | 3/2021 | | |
| CN | 112726912 | A * | 4/2021 | | |
| CN | 112854649 | A * | 5/2021 | | |
| CN | 113136994 | A * | 7/2021 | | |
| CN | 113530134 | A * | 10/2021 | E04F 13/0803 | |
| CN | 114059735 | A * | 2/2022 | | |
| CN | 114704046 | A * | 7/2022 | | |
| CN | 114775947 | A * | 7/2022 | E04F 13/0851 | |
| CN | 116378268 | A * | 7/2023 | | |
| DE | 3032359 | A1 * | 3/1982 | | |
| DE | 3246725 | A1 * | 6/1984 | | |
| DE | 3635479 | A * | 4/1988 | E04F 13/0816 | |
| DE | 102015219967 | A1 * | 4/2017 | | |
| EP | 8272 | A * | 2/1980 | E04F 13/0808 | |
| EP | 1136632 | A1 * | 9/2001 | E04B 2/88 | |
| EP | 2017400 | A1 * | 1/2009 | E04F 13/0855 | |
| EP | 2236693 | A1 * | 10/2010 | E04F 13/0807 | |
| EP | 2299025 | A2 * | 3/2011 | E04F 13/0855 | |
| EP | 3594427 | A1 * | 1/2020 | E04F 13/083 | |
| EP | 4187040 | A1 * | 5/2023 | E04F 13/0816 | |
| ES | 2440118 | A2 * | 1/2014 | E04F 13/007 | |
| GB | 2155072 | A * | 9/1985 | E04F 13/0855 | |
| GB | 2577754 | A * | 4/2020 | E04F 13/0803 | |
| KR | 2001005215 | A * | 1/2001 | E04F 13/0855 | |
| KR | 100838404 | B1 * | 6/2008 | | |
| KR | 20130044522 | A * | 5/2013 | | |
| KR | 480877 | Y1 * | 7/2016 | E04B 1/40 | |
| KR | 2017012990 | A * | 2/2017 | E04F 13/0801 | |
| KR | 101751892 | B1 * | 6/2017 | | |
| KR | 2019002031 | U * | 8/2019 | E04F 13/0835 | |
| KR | 102415459 | B1 * | 7/2022 | | |
| KR | 2022169114 | A * | 12/2022 | E04F 13/0855 | |
| KR | 102601794 | B1 * | 11/2023 | | |
| KR | 20240025964 | A * | 2/2024 | | |
| KR | 2666793 | B1 * | 5/2024 | E04F 13/0846 | |
| KR | 102666793 | B1 * | 5/2024 | | |
| KR | 102685259 | B1 * | 7/2024 | | |
| KR | 102720296 | B1 * | 10/2024 | | |
| WO | 1993012306 | A1 | 6/1993 | | |
| WO | WO-2008115092 | A1 * | 9/2008 | E04F 13/0816 | |
| WO | WO-2010065034 | A2 * | 6/2010 | E04F 13/0808 | |
| WO | WO-2010149623 | A1 * | 12/2010 | E04F 13/0817 | |
| WO | WO-2012048850 | A1 * | 4/2012 | E04F 13/083 | |
| WO | WO-2017016955 | A1 * | 2/2017 | A47B 95/008 | |

* cited by examiner

THREE AXIS CLIP SYSTEM FOR MOUNTING PANELS TO A WALL

RELATED APPLICATIONS

This application claims priority to U.S. Provisional Patent Application Ser. No. 63/355,473 titled, "Three Axis Clip System for Mounting Panels to a Wall," filed on Jun. 24, 2022, the entire contents of which are incorporated herein by reference.

TECHNICAL FIELD

The present invention is directed to a system for coupling a panel to a wall and, more particularly, a clip system for adjusting the position of a wall-mounted panel relative to the wall.

BACKGROUND OF INVENTION

Modular rooms are designed to better integrate manufacturing, enabling higher efficiency and consistency in projects. While framing of modular walls promotes the incorporation of interior components, external paneling and finishes allow for application-specific features, such as lighting, appliance connections, and aesthetics.

Interior finish panels provide a modular room with a unique appearance and features, such as paneling, molding, and window and door framing. These finish panels may be installed on the exterior of an existing wall or panel. However, typical attachment means lack locational adjustability, making it difficult to place finish panels in a desired location with a desired tolerance. The present disclosure improves upon previous methods of finish panel attachment by affording greater control and flexibility during finish panel placement and attachment.

SUMMARY OF THE INVENTION

The present invention is directed to a clip system and methods of using same for installing finish panels on modular walls. In one aspect of the invention, there is provided a clip system having an inverted U-shaped upper portion with an upper T-slot for housing at least one upper T-nut, and at least one upper adjustment screw, each upper adjustment screw configured to extend through a top of the upper portion and into one upper T-nut. The system further includes a receptacle portion configured to be coupled to an exterior face of the upper portion, the receptacle portion and upper portion forming an extrusion groove. Another component of the system is a C-shaped lower portion configured to be coupled to a wall structure, the lower portion having a lower T-slot for housing at least one lower T-nut. At least one middle portion is configured to connect the upper portion with the lower portion, each middle portion having an upper extrusion configured to be received within the upper T-slot and below one upper T-nut of the upper portion, an attachment groove configured to receive the lower portion, and a screw head receptacle region located on an exterior side of the middle portion. Further, the system includes at least one lower adjustment screw, each lower adjustment screw configured to extend into one lower T-nut of the lower portion with its screw head secured within one screw head receptacle region of one middle portion. When the clip system is assembled, rotation of the at least one upper adjustment screw moves the upper portion relative to the at least one middle portion in a first axial direction, rotation of the lower adjustment screw moves the at least one middle portion and upper portion relative to the lower portion in a second axial direction, and a panel mount attached to a finish panel is configured to be received and moved in a third axial direction within the extrusion groove.

In some instances, the lower portion is configured to continuously and horizontally span a section of the wall structure in which at least one finish panel is intended to cover. The upper portion is configured to run continuously and parallel to the lower portion, and the at least one middle portion is configured to support the upper portion above the lower portion. In some instances, the system further comprises at least one additional lower portion configured to be coupled to the wall structure, the at least one additional lower portion configured to be received within the attachment groove of at least one middle portion. In some instances, the receptacle portion is configured to be coupled to the upper portion using one or more receptacle fasteners, and the lower portion is configured to be coupled to the wall structure using one or more wall fasteners. The panel mount includes a panel extrusion that is complementary to the extrusion groove for receiving the panel mount within the extrusion groove. In some instances, rotation of the at least one upper adjustment screw moves the upper portion relative to the at least one middle portion up to 0.5 inches in the first axial direction, and rotation of the lower adjustment screw moves the at least one middle portion and upper portion relative to the lower portion up to 0.5 inches in the second axial direction. Each screw head receptacle region includes an access slider for securing a screw head within the screw head receptacle region.

In another aspect of the present disclosure, there is provided a method of attaching a finish panel to a modular wall. The method includes first fastening a clip system to the modular wall, where the clip system includes an inverted U-shaped upper portion having an upper T-slot housing at least one upper T-nut, and at least one upper adjustment screw, each upper adjustment screw extending through a top of the upper portion and into one upper T-nut. The system further includes a receptacle portion coupled to an exterior face of the upper portion, the receptacle portion and upper portion forming an extrusion groove, and a C-shaped lower portion having a lower T-slot housing at least one lower T-nut. At least one middle portion connects the upper portion with the lower portion, each middle portion having an upper extrusion received within the upper T-slot and below one upper T-nut of the upper portion, an attachment groove receiving the lower portion, and a screw head receptacle region located on an exterior side of the middle portion. The clip system includes at least one lower adjustment screw, each lower adjustment screw extending into one lower T-nut of the lower portion with its screw head secured within one screw head receptacle region of one middle portion.

The next step in the method is rotating the at least one upper adjustment screw to move the upper portion relative to the at least one middle portion in a first axial direction so that the clip system is placed a predetermined first axial position for finish panel placement, and rotating the at least one lower adjustment screw to move the at least one middle portion and upper portion relative to the lower portion in a second axial direction so that the clip system is placed a predetermined second axial position for finish panel placement. The method further includes coupling a panel mount to the finish panel, the panel mount having a panel extrusion configured to be received within the extrusion groove of the receptacle portion of the clip system. Finally, the panel mount of the finish panel is placed within the extrusion groove of the clip system so that the finish panel is attached to the modular wall by reception of the panel mount within the clip system.

In some instances, at least one wall fastener is passed through the lower portion and into the modular wall for fastening the clip to the modular wall. In some instances, the method further includes the step of moving the panel mount within the extrusion groove in a third axial direction so that the finish panel is placed in a predetermined third axial position for finish panel placement.

In some instances, the lower portion continuously and horizontally spans a section of the modular wall in which at least one finish panel is intended to cover. The upper portion runs continuously and parallel to the lower portion, and the at least one middle portion supports the upper portion above the lower portion. In some instances, the receptacle portion is coupled to the upper portion using one or more receptacle fasteners. Rotating the at least one upper adjustment screw moves the upper portion relative to the at least one middle portion up to 0.5 inches in the first axial direction, while rotating the lower adjustment screw moves the at least one middle portion and upper portion relative to the lower portion up to 0.5 inches in the second axial direction. Each screw head receptacle region includes an access slider that secures a screw head within the screw head receptacle region.

A further understanding of the nature and advantages of the present invention will be realized by reference to the remaining portions of the specification and the drawings.

BRIEF DESCRIPTION OF DRAWINGS

The present disclosure same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

The present invention is generally directed to a three dimensional adjustment clip system and methods of using same. A first embodiment of the clip system includes a z-clip with an upper portion, middle portion, and lower portion. The clip portions allow expansion or retraction of the clip in a y-direction and a z-direction, while a panel slides along the clip in the x-direction. Thus, finish panels are adjustable in three directions when attached to an existing wall or panel using the clip system. The adjustment facilitates finish panel placement and spacing from the existing wall or panel within defined tolerances. The lower portion attaches to and spans an existing wall horizontally about the region in which the finish panel is to be placed.

Figure 1:
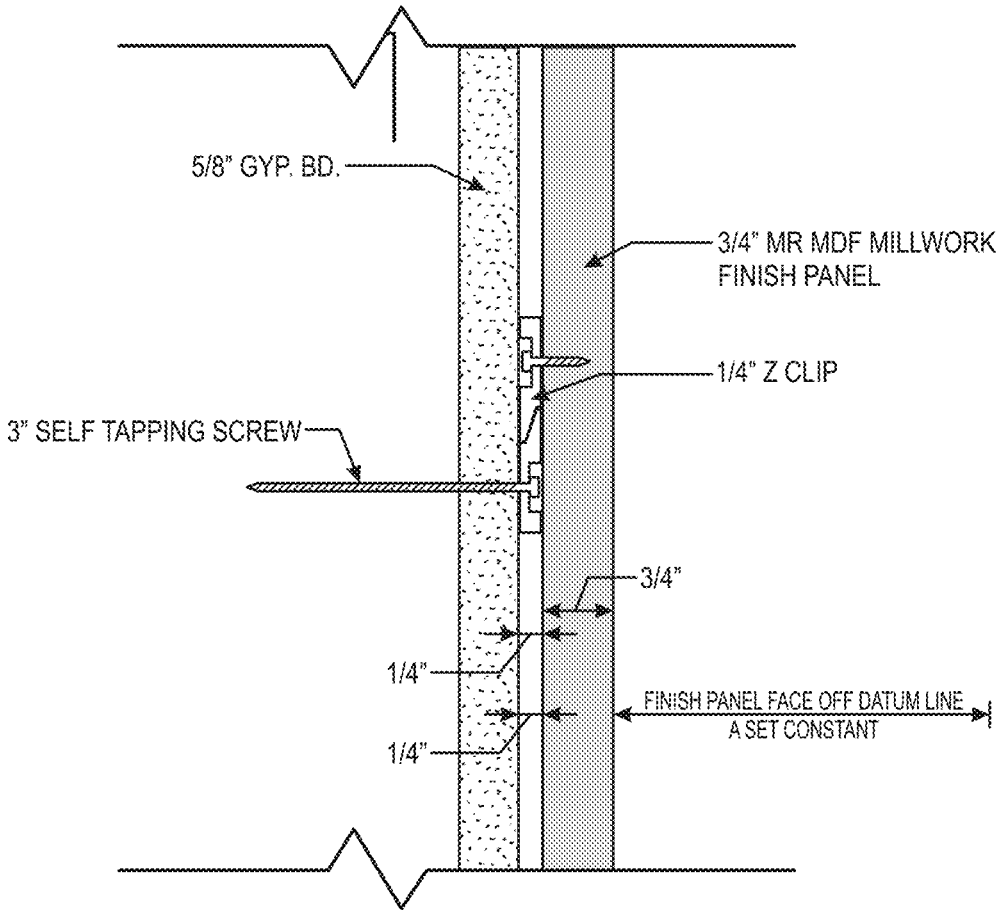
FIG. 1 (PRIOR ART)
FIG. 1 is schematic depicting a prior art clip for attachment of a panel to an existing wall.
Figure 8:
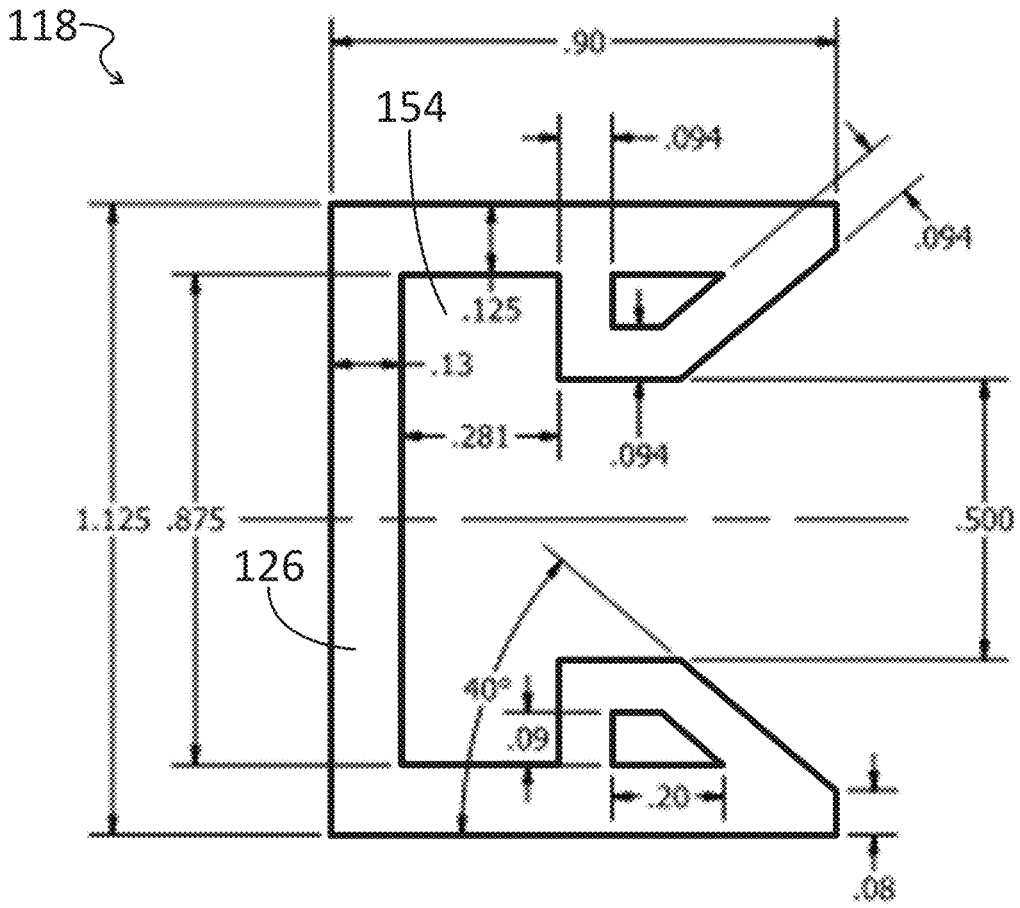
FIG. 8 is a side view dimensional schematic of the lower portion of the clip system of FIG. 2.
Figure 9:
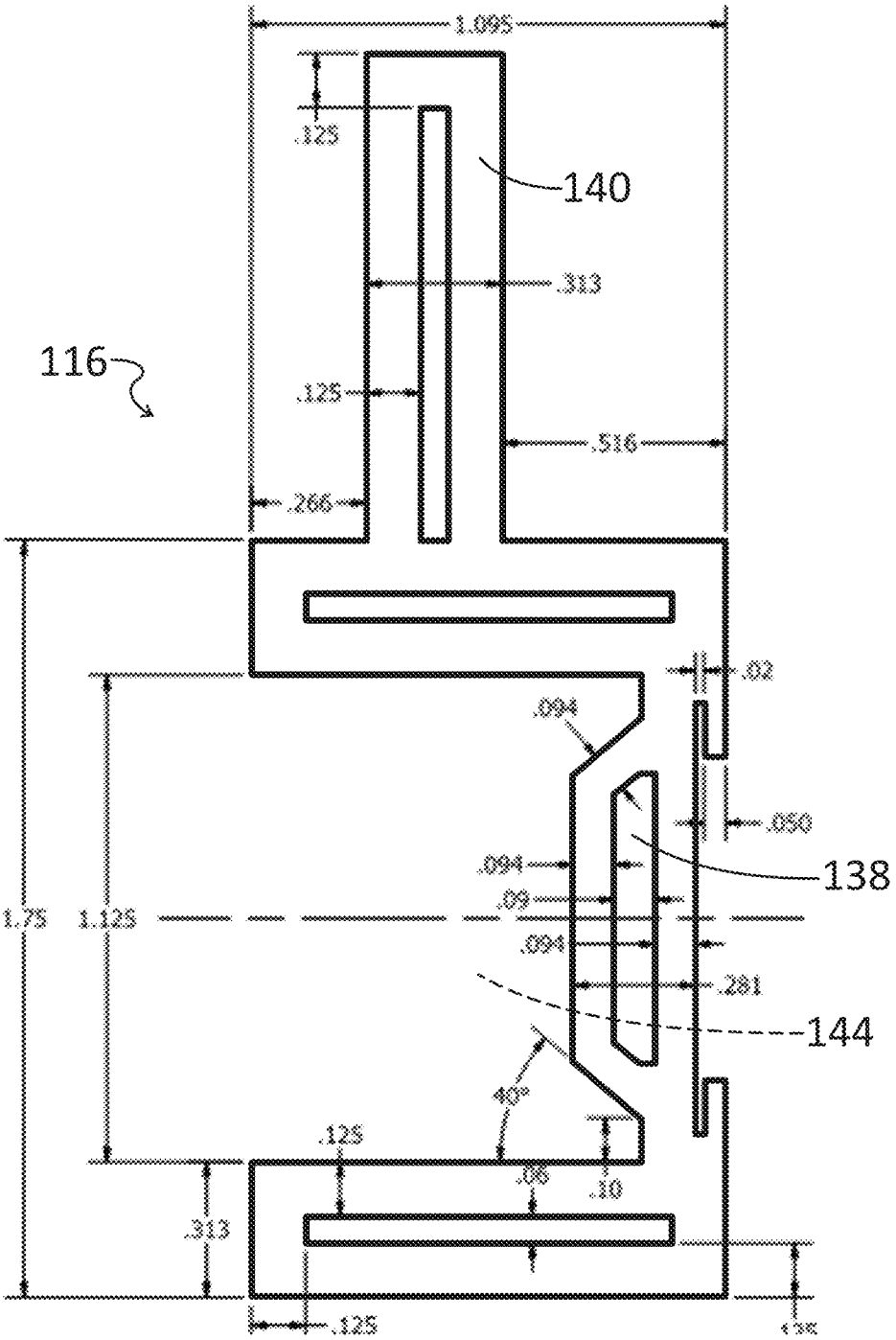
FIG. 9 is a side view dimensional schematic of a middle portion of the clip system of FIG. 2.
Figure 10:
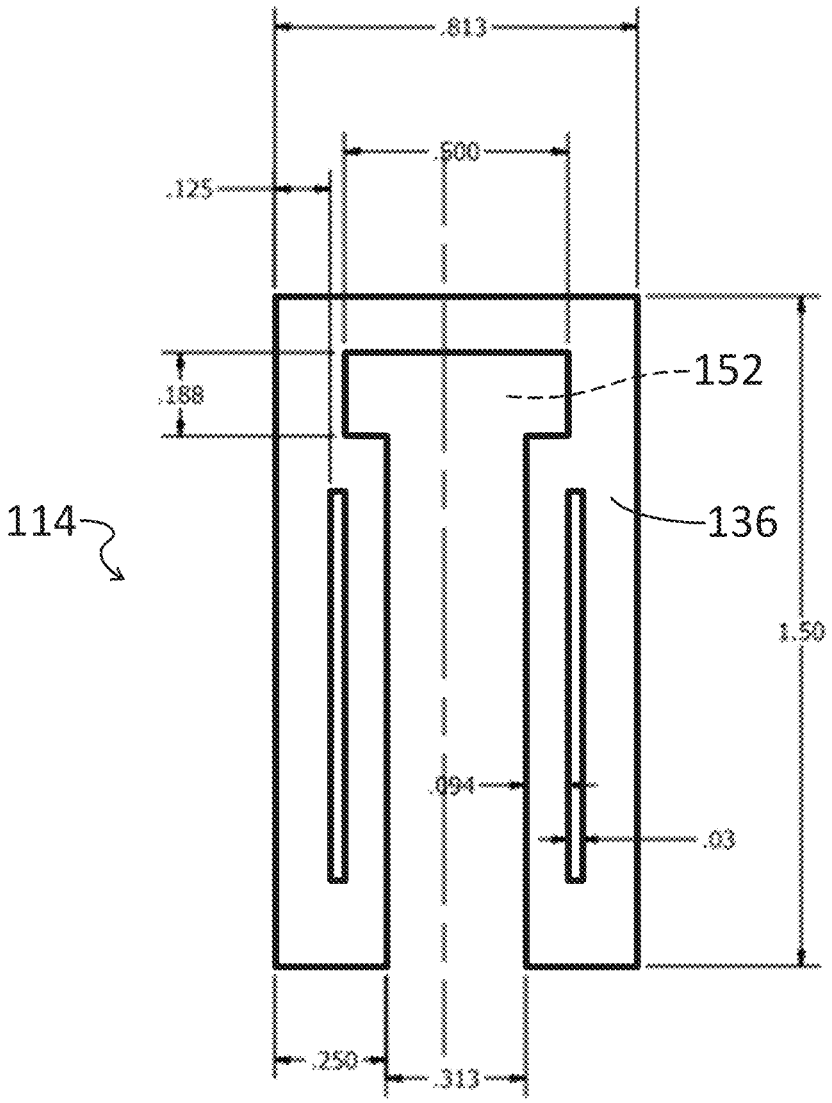
FIG. 10 is a side view dimensional schematic of the upper portion of the clip system of FIG. 2.

FIG. 1 depicts a prior art panel attachment system, upon which the present system improves. FIGS. 2 through 7 depict the clip system of the present disclosure, along with separate upper, middle, and lower portions. FIGS. 8 through 10 show clip dimensions in detail. FIGS. 11 through 14 depict the clip system as it is expanded and as a finish panel is attached using the clip.

A second embodiment of the clip system includes a clip with an upper portion, middle portion, and lower portion.

The clip portions allow expansion or retraction of the clip in a y-direction and a z-direction, while a panel slides along the clip in the x-direction. Thus, finish panels are adjustable in three directions when attached to an existing wall or panel using the clip system. The adjustment facilitates finish panel placement and spacing from the existing wall or panel within defined tolerances. At least one lower portion attaches to an existing wall about the region in which the finish panel is to be placed.

Figure 21:
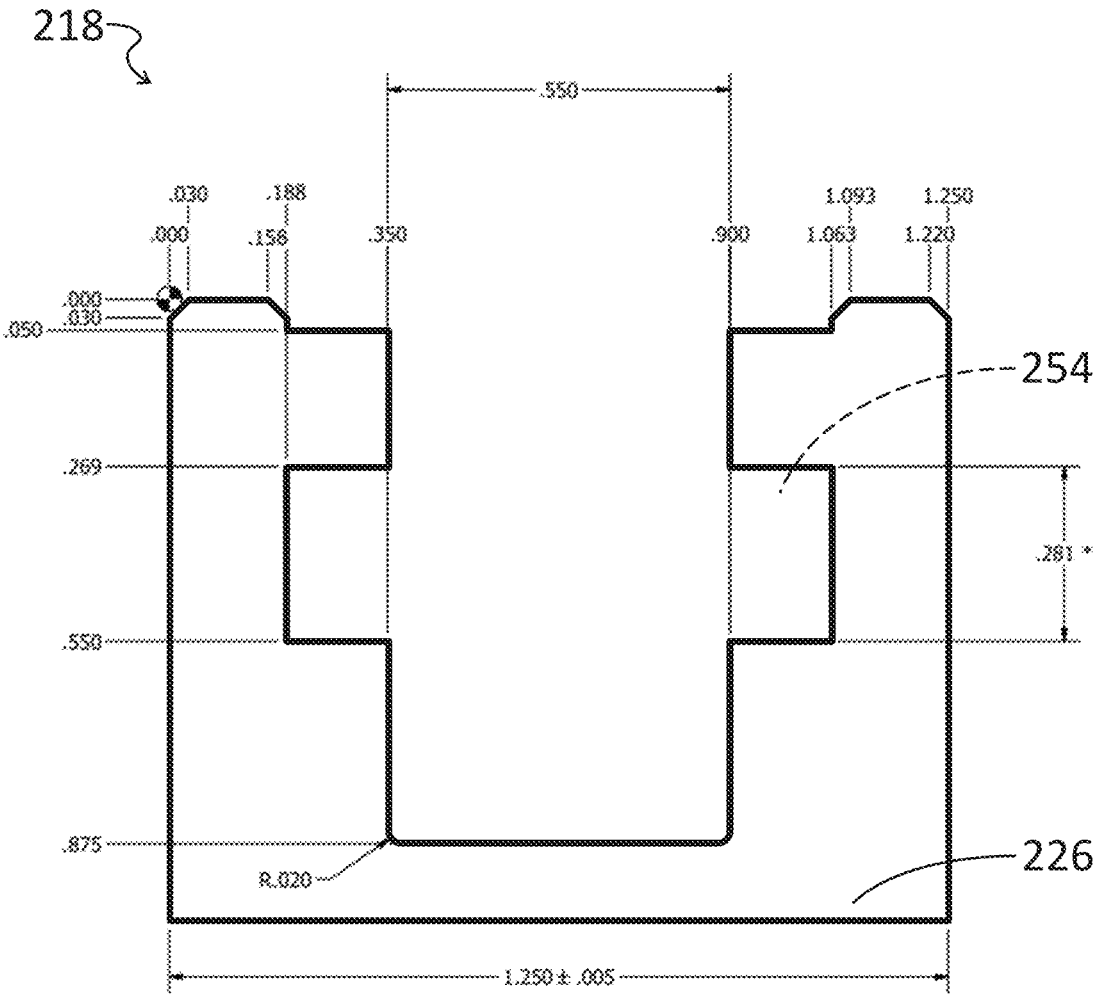
FIG. 21 is a side view dimensional schematic of the lower portion of the clip system of FIG. 15.
Figure 22:
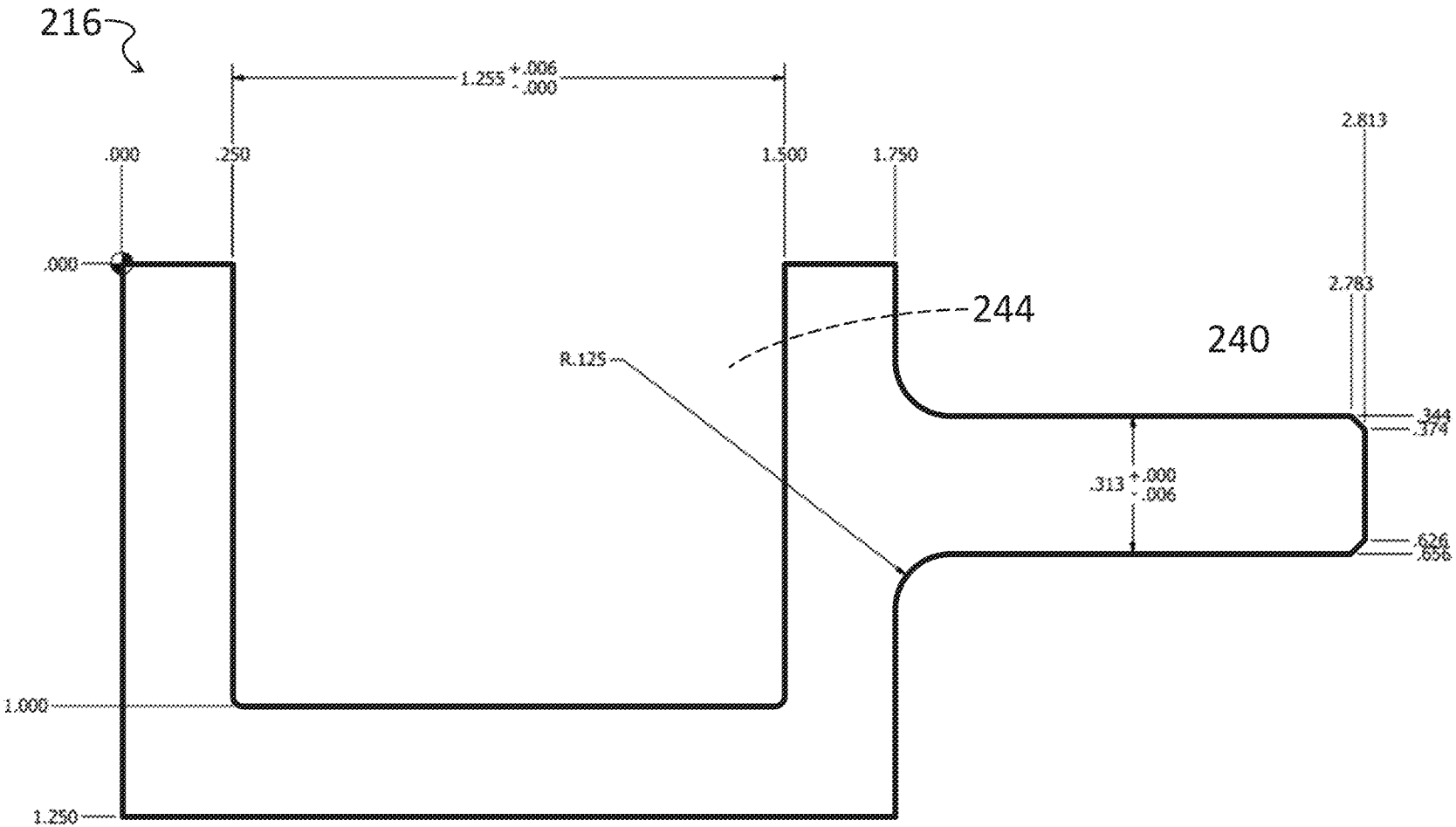
FIG. 22 is a side view dimensional schematic of a middle portion of the clip system of FIG.
Figure 23:
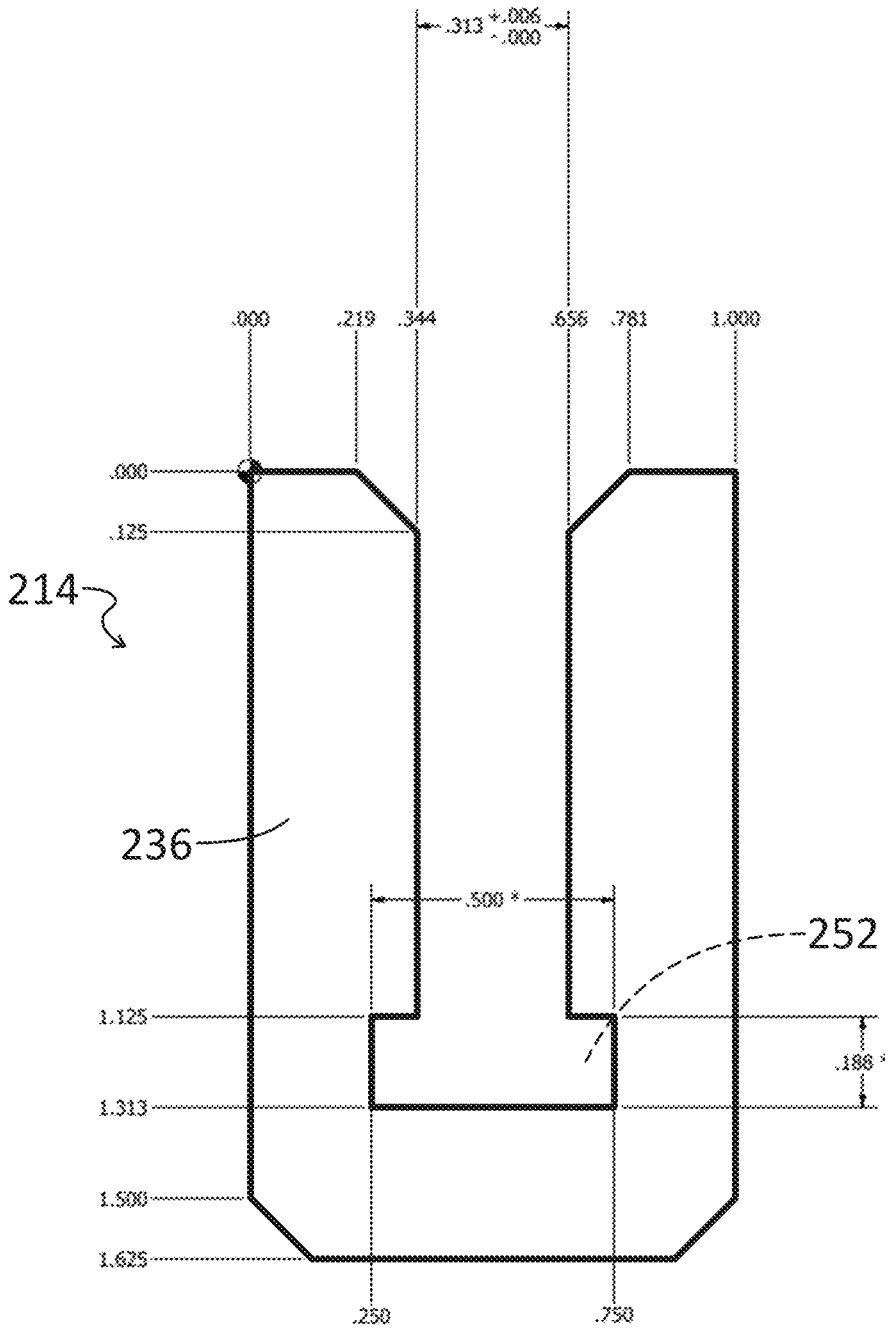
FIG. 23 is a side view dimensional schematic of the upper portion of the clip system of FIG. 15.

FIGS. 15 through 20 depict the clip system of the present disclosure, along with separate upper, middle, and lower portions. FIGS. 21 through 23 show clip dimensions in detail. FIGS. 24 through 27 depict the clip system as it is expanded and as a finish panel is attached using the clip.

Referring to FIG. 1, there is depicted a typical prior art system for the attachment of finish panels to existing walls or panels. The exemplary prior art system in FIG. 1 uses a self-tapping screw to anchor a finish panel to an existing wall. In order to adjust the position of the prior art system along a wall, screws must be removed, the prior art clip must be shifted, and screws must be re-inserted. Further, shims that adjust the z-directional position are only capable of adjustments in increments of the smallest shim, which is typically $1/16^{th}$ of an inch. Thus, prior art systems are difficult to adjust for a precise attachment of a finish panel in a location within a desired spacing tolerance.

Figure 2:
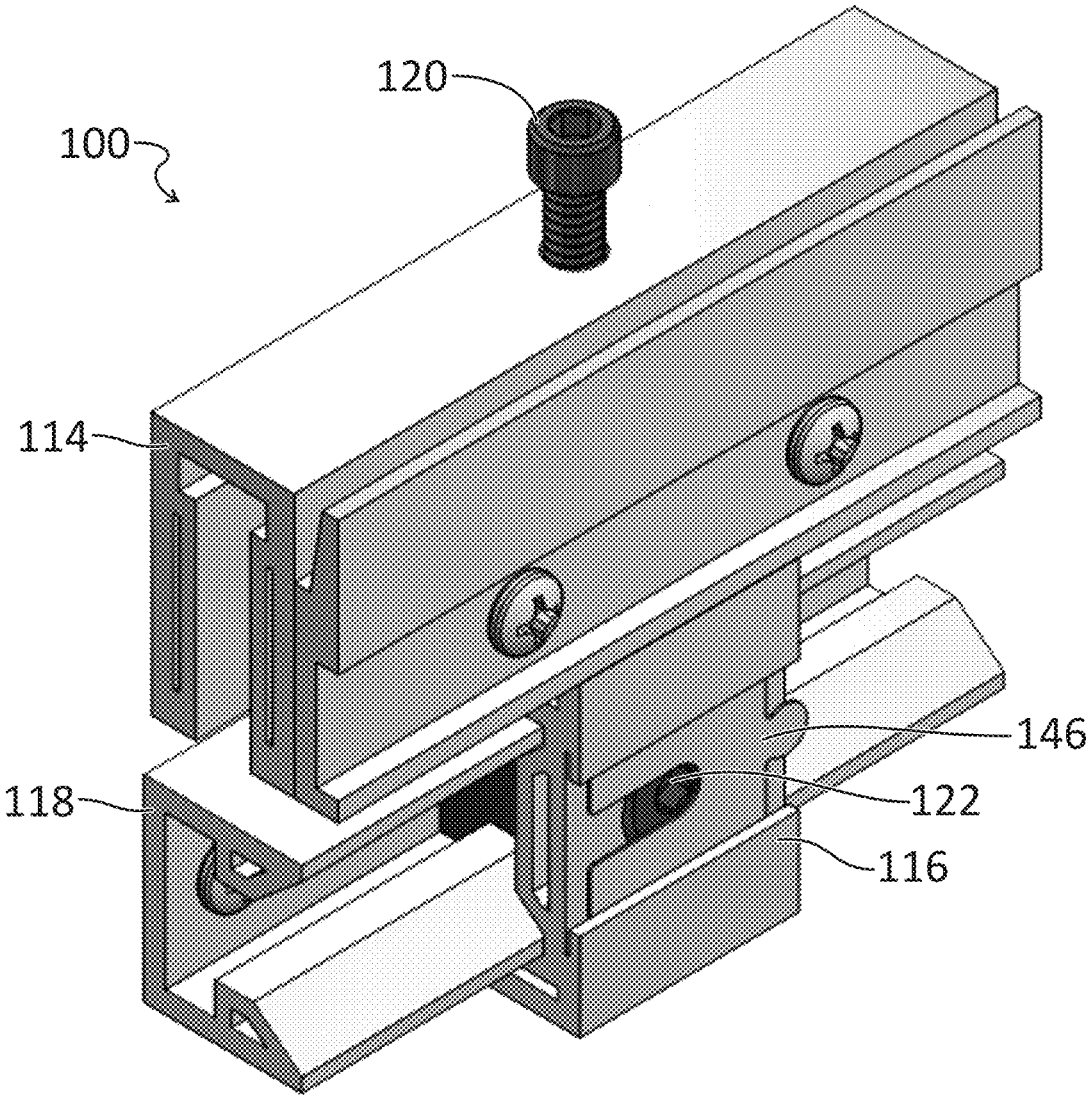
FIG. 2 is a perspective view schematic of a representative clip system of a first embodiment of the present disclosure with three dimensions of adjustability.

Now referring to FIG. 2, the clip system 100 of the present disclosure is depicted. Clip system 100 includes components for expansion or retraction, facilitating the precising positioning of a finish panel 110. For instance, it is often desirable to attach or mount finish panels 110 over existing walls 112 in modular rooms. Finish panels 110 have a desired surface area and depth and include an appearance or features that is visible from the interior of the modular room. Finish panels 110 generally are designed to completely cover existing walls 112 in a modular room. The location of finish panel 110 and spacing from existing walls 112 are often specified and include a desired tolerance. Desired locations, spacings, and tolerances vary depending on application. For example, a desired spacing between existing wall 112 and finish panel 110 may be ¼ inch and include a tolerance of ±1/32 inch. Locations of existing wall 112 and finish panel 110 may include a tolerance of ±½ inch. However, other precise locations, spacings, and tolerances are compatible with the present disclosure. In some instances, system 100 is configured to correct for imperfections in existing walls 112 and to provide a straight and true receptacle for finish panel 110 mounting. Thus, when existing walls 112 are uneven or irregular, system 100 is adjusted to correct for such irregularities.

Clip system 100 includes an essentially inverted U-shaped upper portion 114, a middle portion 116, and an essentially C-shaped lower portion 118 that are adjusted to achieve expansion or retraction. Upper portion 114 is moved up and down in a y-direction relative to middle portion 116 using a first or upper adjustment screw 120, as is described below in greater detail. Middle portion 116 is moved toward or away from lower portion 118 in a z-direction using a second or lower adjustment screw 122, as is likewise described below in greater detail. Lower portion 118 is configured to be attached to existing wall 112 and remains stationary relative to existing wall 112. Upper portion 114 and lower portion 118 are continuously run horizontally along existing wall 112, while one or more middle portion 116 is installed periodically along upper portion 114 and lower portion 118. Thus, while FIG. 2 depicts one instance of middle portion 116 installation, more than one middle portion 116 is included in clip system 100 in embodiments not depicted. Upper portion 114 and lower portion 118 at least partially span existing wall 112, though only a representative section of clip system 100 is depicted in FIG. 2. Features and configurations of each portion are described in greater detail below. When existing wall 112 is substantially flat, upper portion 114 is parallel to lower portion 118. However, when existing wall 112 has imperfections, uneven areas, or irregularities, upper portion 114 is not necessarily parallel to lower portion 118. For instance, lower portion 118 may span existing wall 112 at a slope based on the slope of existing wall 112. In this instance, more than one middle portion 116 may be attached to lower portion 118 at different z-direction depths such that upper portion 114 is configured to receive finish panel 110 in an even and level orientation.

Figure 3:
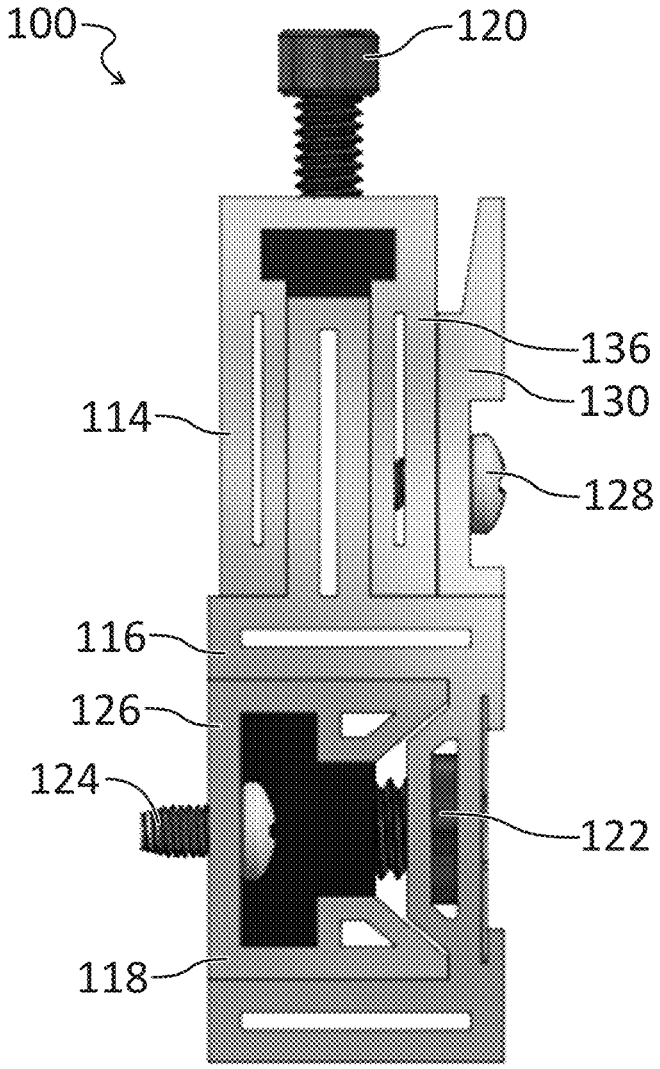
FIG. 3 is a side view schematic of the clip system of FIG. 2 in a retracted configuration.

FIG. 3 shows a side view of clip system 100 in a retracted configuration. In such a situation, both upper portion 114 and middle portion 116 are retracted. Clip system 100 and portions are composed of metal, such as steel, aluminum, titanium, iron, alloys, or other metals. In some instances, clip system 100 is composed at least partially of plastic or polymers. The material or materials of clip system 100 are such that it is configured to be stably mounted on existing wall 112 or panel and configured to support finish panel 110 in the desired location. Clip system 100 is mounted or attached to existing wall 112 at lower portion 118 using at least one wall fastener 124, which is a screw, bolt, nail, or other fastening means known in the art. The threading and length of wall fastener 124 varies depending on application. Similarly, the number of wall fasteners 124 is depicted to be two, though other numbers of wall fasteners 124 are compatible such that they securely attach clip system 100 to existing wall 112. The number of wall fasteners 124 varies based on the width of lower portion 118 required to install finish panel 110. Wall fasteners 124 span openings in a lower portion sidewall 126 and extend outward from clip system 100 and into existing wall 112, when present.

Also shown in FIG. 3 is at least one receptacle fastener 128 for fastening receptacle portion 130 to an exterior surface of upper portion 114. Receptacle portion 130 is included for receiving an extrusion 132 of panel mount 134, as is described below in greater detail. Receptacle portion 130 is attached to upper portion sidewall 136 by at least one receptacle fastener 128, which spans openings in both receptacle portion 130 and upper portion sidewall 136. Receptacle fastener 128 is a screw, bolt, nail, or other fastening means known in the art. The threading and length of receptacle fastener 128 varies depending on the width of upper portion 114 and the size of finish panel 110 to be installed. Similarly, the number of receptacle fasteners 128 is depicted to be two, though other numbers of receptacle fasteners 128 are compatible such that they securely attach receptacle portion 130 to upper portion 114.

Figure 4:
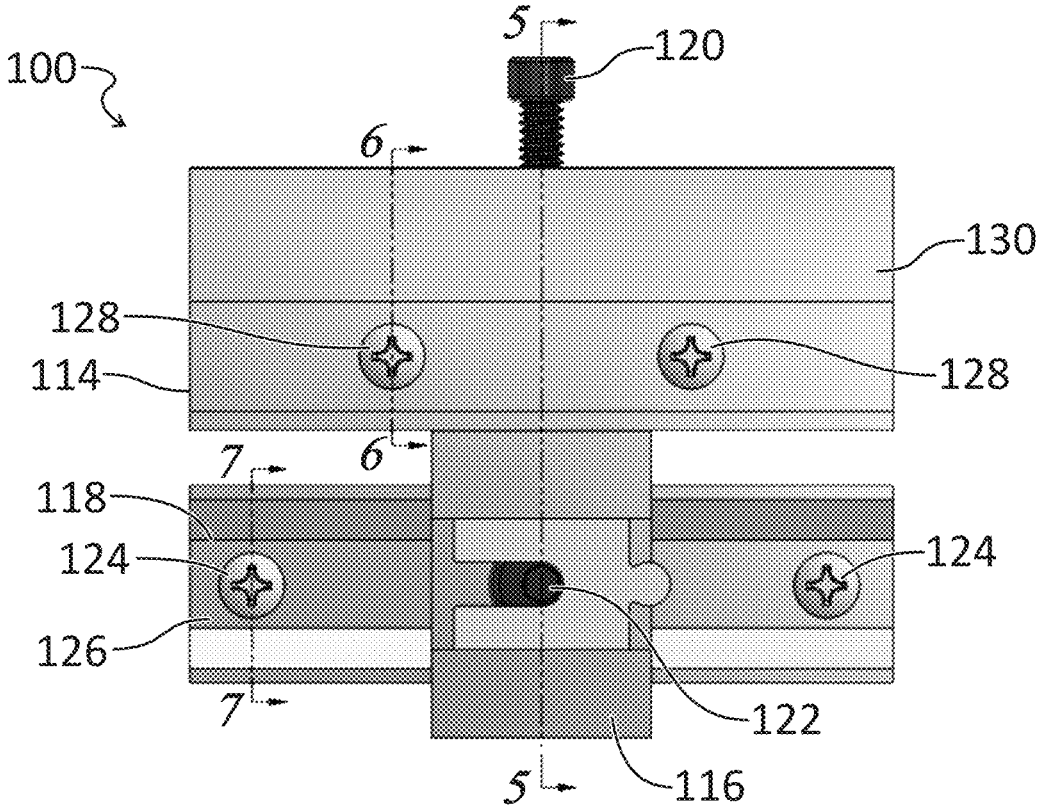
FIG. 4 is a front view schematic of the clip system of FIG. 2 in a retracted configuration with sectional cut-through lines indicated.

Referring now to FIG. 4, there is depicted a front view of a representative portion of clip system 100. In this representation, two wall fasteners 124 and two receptacle fasteners 128 are visible, however other numbers of fasteners are possible, as both upper portion 114 and lower portion 118 are configured to horizontally span portions of existing wall 112 to support finish panel 110. FIG. 4 also marks sectional view lines A-A, B-B, and C-C, which indicate the locations of sectional views depicted in FIG. 5, FIG. 6, and FIG. 7, respectively. The size of clip system 100 is such that it is mountable on existing wall 112 and configured to support panel mount 134 on finish panel 110. Thus, sizes of clip system vary depending on the application and size of finish panel 110. Similarly, the number and spacing of middle portions 116 varies such that finish panel 110 is supported on existing wall 112 using clip system 100. In some instances, more than one clip system 100 is used to position and support several finish panels 110.

Figure 5:
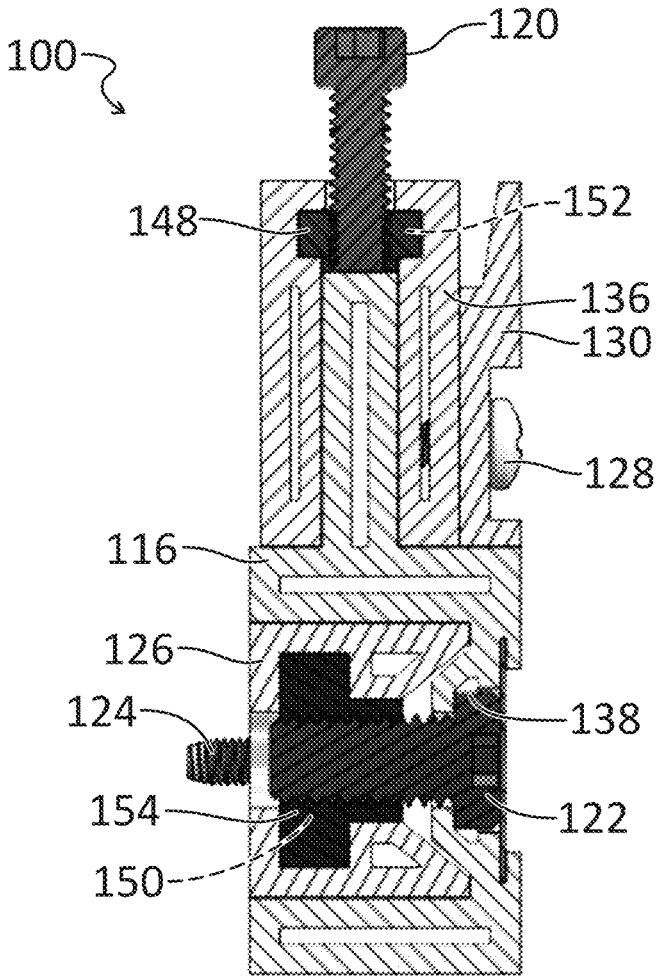
FIG. 5 is a side sectional view schematic of the clip system of FIG. 4 about sectional line A-A.

In FIG. 5, a sectional view of clip system 100 at line A-A of FIG. 4 is depicted. Clip system 100 has a length of 3.25 inches, excluding first adjustment screw 120. However, other heights are possible. While clip system 100 is shown in a retracted configuration, rotation of first adjustment screw 120 increases the distance between upper portion 114 and middle portion 116, effectively increasing the height of clip system 100. Similarly, clip system has a depth of 1.11 inches, excluding wall fastener 124. However, other depths are possible. While clip system 100 is shown in a retracted configuration, rotation of second adjustment screw 122 increases the distance between middle portion 116 and lower portion 118, effectively increasing the depth of clip system 100. The width of clip system 100 varies, as upper portion 114 and lower portion 118 are configured to horizontally span a portion of existing wall 112 sufficient for the mounting of finish panel 110. Thus, the width of clip system 100 depends at least partially on the size of finish panel 110.

First adjustment screw 120 is shown as having a threaded section with a 0.28 inch outer diameter, while second adjustment screw 122 has a threaded section with a 0.39 inch outer diameter. However, other outer diameters are possible such that adjustment screws fit within their openings in clip system 100. First adjustment screw 120 is threaded to be received in a counterpart first or upper T-nut 148, while second adjustment screw 122 is threaded to be received in counterpart second or lower T-nut 150. Second adjustment screw 122 further includes a screw head with a 0.59 inch outer diameter. However, other screw head sizes are possible, such that the screw head is larger than the opening for the threaded region of second adjustment screw 122 and rests within screw head receptacle region 138. The number of first adjustment screws 120, second adjustment screws 122, first T-nuts 148, and second T-nuts 150 vary depending on the number of middle portions 116 periodically attached along upper portion 114 and lower portion 118. Thus, each middle portion 116 includes one of each: first adjustment screw 120, second adjustment screw 122, first T-nut 148, and second T-nut 150. FIG. 5 depicts an exemplary sectional view of one middle portion 116 attached to the tracks of upper portion 114 and lower portion 118, though more than one middle portion 116 is configured to be attached to upper portion 114 and lower portion 118.

FIG. 5 shows that first adjustment screw 120 contacts a top wall of middle portion 116 when fully inserted. When first adjustment screw 120 is rotated clockwise, it rotates within first T-nut 148, allowing upper portion 114 to move upward. On the other hand, when first adjustment screw 120 is rotated counter-clockwise, upper portion 114 moves toward middle portion 116. Thus, upper portion 114 is adjustable in the y-direction by rotating first adjustment screw 120. When more than one middle portion 116 is present, each first adjustment screw 120 is rotated to adjust upper portion 114 in the y-direction.

Second adjustment screw 122 is configured to contact lower portion sidewall 126 when fully inserted. When second adjustment screw 122 is rotated clockwise, it rotates within second T-nut 150, allowing middle portion 116 to move outward. On the other hand, when second adjustment screw 122 is rotated counter-clockwise, middle portion 116 moves toward lower portion 118 and existing wall 112, if present. Thus, middle portion 116 is adjustable in the z-direction by rotating second adjustment screw 122. When more than one middle portion 116 is present, each second adjustment screw 122 is rotated to adjust middle portions 116 and attached upper portion 114 in the z-direction.

Figure 6:
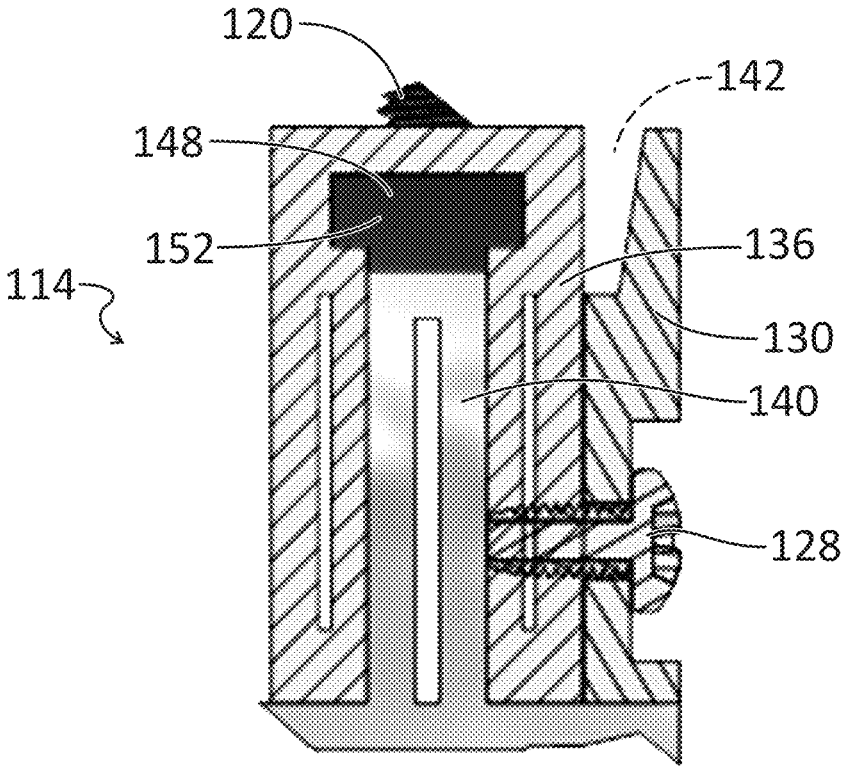
FIG. 6 is a side sectional view schematic of an upper portion the clip system of FIG. 4 about sectional line B-B.

In FIG. 6, a sectional view of upper portion 114 at line B-B of FIG. 4 is depicted. Receptacle portion 130 is connected to upper portion 114 using receptacle fasteners 128, which travel through openings in both receptacle portion 130 and upper portion sidewall 136. The outer diameter of each receptacle fastener 128 is such that it fits within openings in both receptacle portion 130 and upper portion sidewall 136, while the head of each receptacle fastener 128 is such that it does not fit within openings in both receptacle portion 130 and upper portion sidewall 136. Threading and sizes vary depending on application.

Receptacle portion 130 has a length and width that are approximately equal to those of upper portion 114, such that, when attached, receptacle portion 130 covers upper portion sidewall 136. However, in embodiments not depicted, receptacle portion 130 is larger or smaller than upper portion sidewall 136, or multiple receptacle portions 130 are attached to upper portion 114. Receptacle portion 130 and upper portion sidewall 136 form an extrusion groove 142 between the top of receptacle portion 130 and upper portion sidewall 136. Extrusion groove 142 is of a shape and size compatible with the stable reception of extrusion 132 of panel mount 134. When extrusion 132 is received within extrusion groove 142, it secures panel mount 134 and any attached finish panel 110 to clip system 100 and any attached existing wall 112.

Each middle portion 116 is configured to be moveably connected with upper portion 114 through upper extrusion 140, which is configured to reside within upper portion 114. Upper portion 114 moves with respect to each middle portion 116 when each first adjustment screw 120 is rotated. Upper extrusion 140 of each middle portion 116 has a width that is such that it fits between pairs of receptacle fasteners 128, as depicted, though in other embodiments the width is greater than the spacing between receptacle fasteners 128. Each first T-nut 148 is housed within an upper T-slot 152 of upper portion 114 and above each upper extrusion 140. Thus, each first T-nut 148 is secured within upper portion 114.

Figure 7:
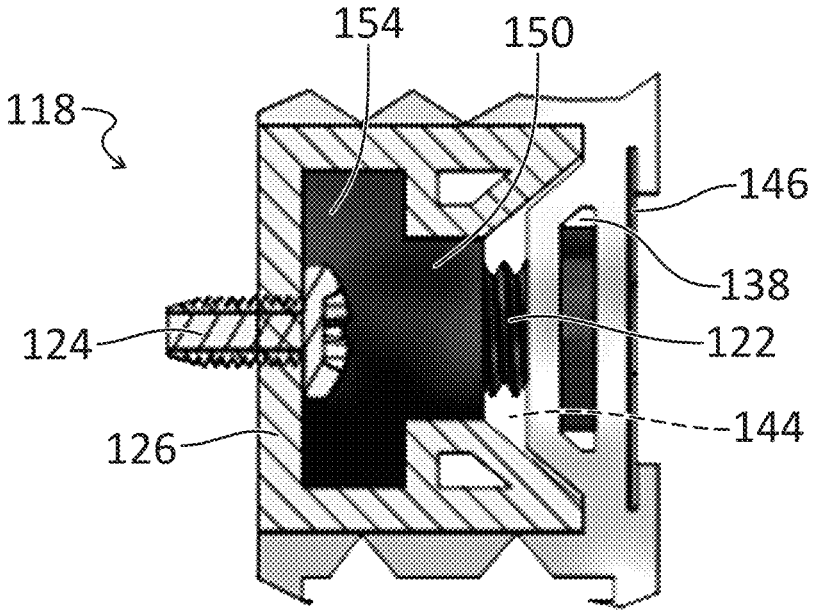
FIG. 7 is a side sectional view schematic of a lower portion the clip system of FIG. 4 about sectional line C-C.

Referring now to FIG. 7, a sectional view of lower portion 118 at line C-C of FIG. 4 is depicted. An attachment groove 144 of each middle portion 116 at least partially surrounds lower portion 118. This positioning is adjustably secured with each second adjustment screw 122, which extends through an opening in screw head receptacle region 138 of middle portion 116 and into second T-nut 150. When each second attachment screw 122 is rotated, it allows each middle portion 116 (and upper portion 114, when attached to middle portions 116) to move relative to lower portion 118. Each middle portion 116 has a width that is less than that of lower portion 118, such that lower portion 118 extends through attachment groove 144. Access to second adjustment screws 122 is covered in some instances, such as through access slider 146 shown in FIG. 2 and in profile in FIG. 7. By sliding access slider 146, a window either becomes aligned or unaligned with second adjustment screw 122, thus providing or denying access to rotation of second adjustment screw 122. While access slider 146 is depicted as access means to second adjustment screw 122, other access means are compatible with the present disclosure, including gates and flaps. Access slider 146 further holds second adjustment screw 122 in position during screw rotation, as is described below. The number of access sliders 146 is such that each second adjustment screw 122 is protected by one access slider 146, and thus varies with the number of second adjustment screws 112 and middle portions 116.

Screw head receptacle region 138 is positioned and sized such that the head of second adjustment screw 122 rests flush with the exterior of middle portion 116. Access slider 146 holds the head of second adjustment screw 122 within screw head receptacle region 138, even when it is rotated. Thus, access slider 146 regulates access to rotating second adjustment screw 122 while also holding the screw head in its location within screw head receptacle region 138 of each middle portion 116. Each second T-nut 150 is configured to receive one second adjustment screw 122 and is housed within a lower T-slot 154 of lower portion 118. Each second T-nut 150 is secured within lower portion 118.

Referring now to FIG. 8, there is depicted a dimensional line drawing of a cross section of lower portion 118. Lower portion 118 is depicted to have a length of 1.125 inches and a depth of inches, though other sizes are possible such that lower portion 118 spans a desired portion of existing wall 112 and is received within each attachment groove 144 of each middle portion 116. Lower T-slot 154 is shown to have a length of 0.875 inches and a depth of 0.281 inches, though other dimensions are possible such that each second T-nut 150 is snugly received within lower T-slot 154. An opening of 0.5 inches is provided for portions of each second T-nut 150 and second adjustment screw 122. However, other dimensions of openings are compatible with the present disclosure such that each second T-nut 150 and second adjustment screw 122 fit within.

In FIG. 9, there is depicted a dimensional line drawing of a cross section of an exemplary middle portion 116. Middle portion 116 is depicted to have a length of approximately 3 inches and a depth of 1.095 inches, though other sizes are possible. Attachment groove 144 has a length of 1.125 inches, though other lengths are possible such that lower portion 118 is received within attachment groove 144. Upper extrusion 140 is shown to have a depth of 0.313 inches, though other dimensions are possible such that upper extrusion 140 is received within upper portion 114. Access slider 146 fits within a slot of approximately 0.02 inches, though other slot sizes are possible such that access slider 146 is accommodated and movable within the slot. A depth of approximately 0.281 inches is provided for the head of second adjustment screw 122 to reside within screw head receptacle region 138. However, other dimensions of are compatible with the present disclosure such that the head of second adjustment screw 122 fits within screw head receptacle region 138.

Referring now to FIG. 10, there is depicted a dimensional line drawing of a cross section of upper portion 114. Upper portion 114 is depicted to have a length of 1.5 inches and a depth of inches, though other sizes are possible such that each upper extrusion 140 of each middle portion 116 is received within upper portion 114. Upper T-slot 152 is shown to have a length of inches and a depth of 0.5 inches, though other dimensions are possible such that each first T-nut 148 is snugly received within upper T-slot 152. An opening of 0.313 inches is provided for portions of each first T-nut 148 and first adjustment screw 120, as well as for reception of each upper extrusion 140. However, other dimensions of openings are compatible with the present disclosure such that each first T-nut 148, first adjustment screw 120, and upper extrusion 140 fit within.

Figure 11:
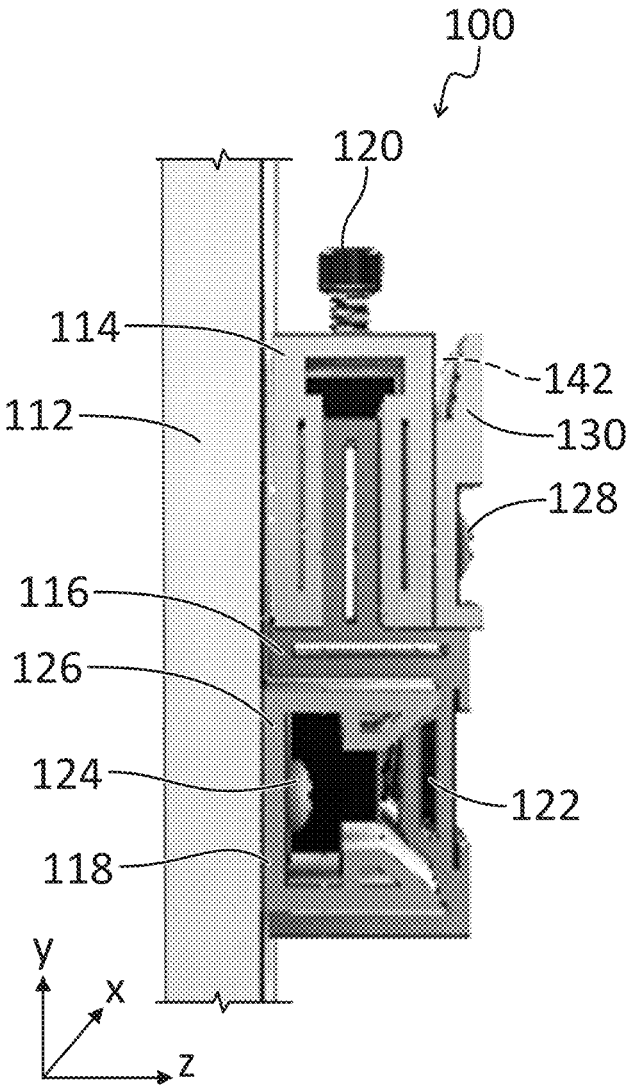
FIG. 11 is a side perspective view schematic of the clip system of FIG. 2 on an existing wall in a retracted configuration.

In FIG. 11, there is depicted an exemplary portion of clip system 100 mounted on existing wall 112 and placed in a fully retracted configuration. In the exemplary section, one middle portion 116 is displayed, though more than one middle portion 116 is compatible with the present disclosure. Similarly, upper portion 114 and lower portion 118 are shown in cross section, though are configured to extend along a desired width of existing wall 112. The mounting is performed by a user who fastens one or more wall fasteners 124 of lower portion 118 to a steel frame of existing wall 112 using fastening methods and tools known in the art. However, attachment to other wall materials are possible such that clip system 100 is securely installed along existing wall 112 and such that clip system 100 is capable of stably supporting finish panel 110. As lower portion 118, one or more middle portions 116, and upper portion 114 are connected to each other, clip system 100 is mounted when wall fasteners 124 are fastened to existing wall 112. In the fully retracted configuration, first adjustment screws 120 and second adjustment screws 122 are retracted, such that upper portion 114 is not expanded in the y-direction, and one or more middle portions 116 and upper portion 114 are not expanded in the z-direction.

Figure 12:
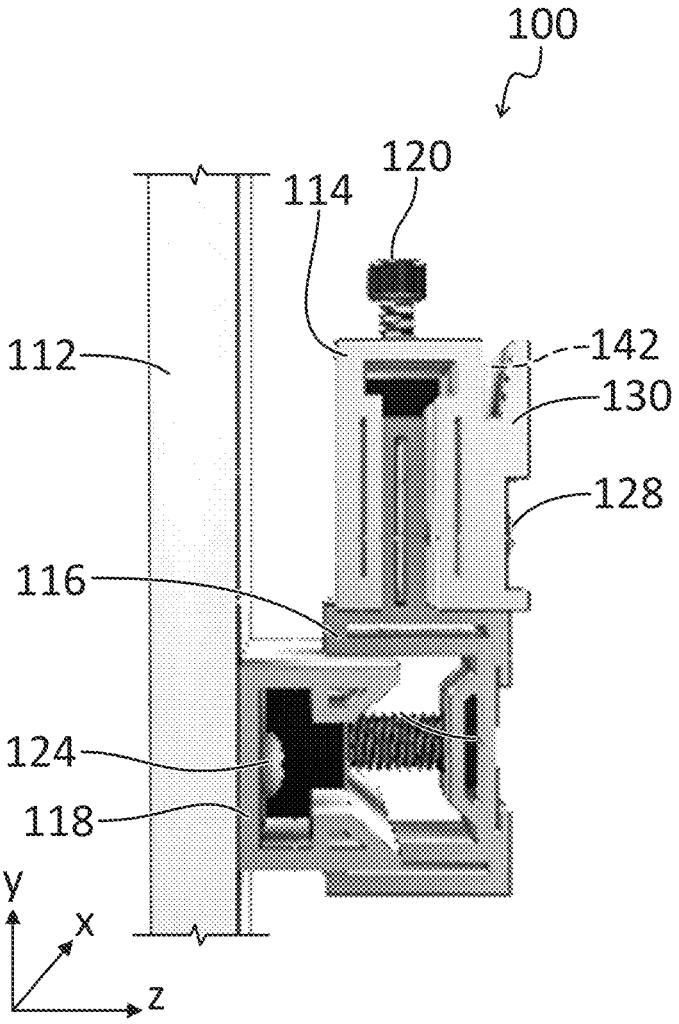
FIG. 12 is a side perspective view schematic of the clip system of FIG. 2 on an existing wall in a partially extended configuration, with extension in a z-direction and retraction in a y-direction.

In FIG. 12, there is depicted an exemplary portion of clip system 100 mounted on existing wall 112 and placed in a partially expanded configuration. In this case, each middle portion 116 and the attached upper portion 114 are expanded in the z-direction when each second adjustment screw 122 is rotated within its second T-nut 150. Expansion in the z-direction is shown to have a maximum distance of 0.5 expanded inches, though other distances of expansion are possible with different lengths of second adjustment screws 122 and different depth dimensions of middle portions 116 and lower portion 118.

Figure 13:
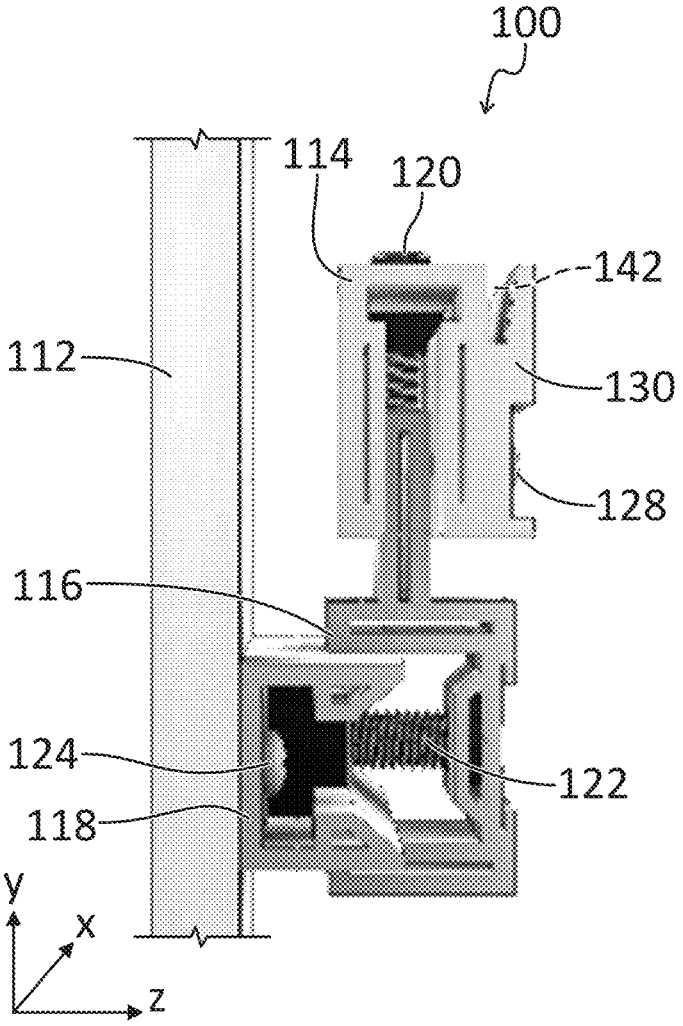
FIG. 13 is a side perspective view schematic of the clip system of FIG. 2 on an existing wall in an extended configuration, with extension in both the z-direction and the y-direction.

Referring now to FIG. 13, there is depicted an exemplary portion of clip system 100 mounted on existing wall 112 and placed in a fully expanded configuration. In a fully expanded configuration, clip system is fully expanded in both the y-direction and the z-direction. The z-direction expansion is described above in relation to FIG. 12. For the y-direction expansion, upper portion 114 is expanded relative to each middle portion 116 when each first adjustment screw 120 is rotated within its first T-nut 148. Expansion in the y-direction is shown to have a maximum distance of approximately 0.5 expanded inches, though other distances of expansion are possible with different lengths of first adjustment screws 120.

Figure 14:
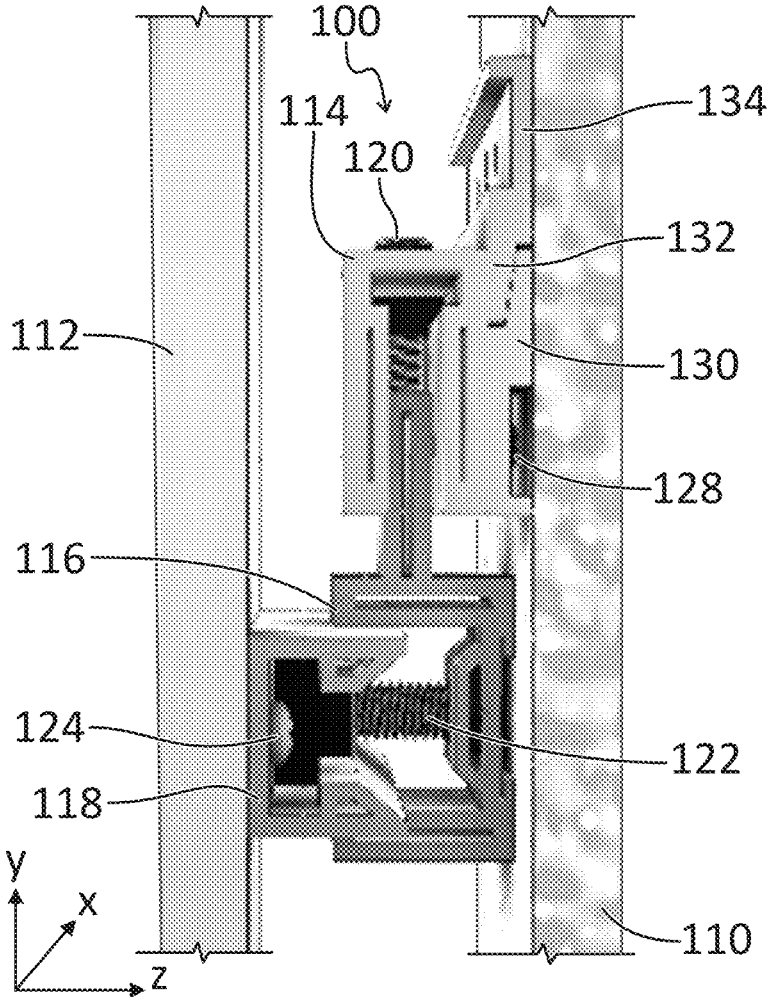
FIG. 14 is a side perspective view schematic of the clip system of FIG. 2 on an existing wall in an extended configuration, with a finish panel attached.

In FIG. 14, a fully expanded clip system 100 is depicted with finish panel 110 attached. Along an existing wall-facing surface of finish panel 110 is attached one or more panel mounts 134. In some instances, one panel mount 134 spans finish panel 110, while in other instances several panel mounts 134 are periodically, horizontally placed along finish panel 110. The location of the one or more panel mount 134 is such that panel mount 134 is configured to fit into complementary receptacle portion 130. More specifically, each extrusion 132 of panel mount 134 is configured to be received within extrusion groove 142 of receptacle portion 130. When mounted, finish panel 110 covers a desired portion of existing wall 112, and thus the locations of mounted clip system 100 on existing wall 112 and panel mount 134 on finish panel 110 are such that the desired coverage is achieved. Clip system 100 provides flexibility in finish panel positioning in the x-direction, as panel mount 134 is configured to slide horizontally within extrusion groove 142. Thus, clip system 100 provides adjustability in x, y, and z-directions. Additionally, finish panel 110 is removable from clip system 100 when extrusion 132 of panel mount 134 is lifted up and out of extrusion groove 142.

Thus, finish panels 110 may be removed or exchanged along existing wall 112 without damage to clip system 100 or existing wall 112.

In some instances, components of clip system 100 are commercially available. For instance, access slider 146, first adjustment screw 120, second adjustment screw 122, first T-nut 148, and second T-nut 150 are commercially available in varying sizes and shapes. An exemplary access slider 146 has a depth of 0.02 inches, a width of 1 inch, and a length of 1 inches, with an access slot length of 0.25 inches for screw rotation. However, other dimensions are compatible with the present disclosure such that access slider 146 slides within its slot in middle portion 116, provides access to second adjustment screw rotation, and prevents the removal of the head of second adjustment screw 122 from screw head receptacle region 138 during screw rotation. An exemplary first adjustment screw 120 has a threaded region length of 0.75 inches, a screw head length of 0.25 inches, a 0.38 inch head diameter, a ¼ inch shaft diameter, and 20 threads per inch. However, other dimensions are possible such that first adjustment screw 120 fits within first T-nut 148. An exemplary second adjustment screw 122 has a threaded region length of 0.75 inches, a screw head length of 0.19 inches, a 0.56 inch head diameter, a ⅜ inch shaft diameter, and 16 threads per inch. However, other dimensions are possible such that second adjustment screw 122 fits within second T-nut 150. First adjustment screw 120 and second adjustment screw 122 are depicted having a 0.188 hex head, though other screw head types and fastening means are compatible with the present disclosure. An exemplary first T-nut 148 has a total height of 0.25 inches, a maximum width of 0.5 inches, a minimum width of 0.31 inches, and threading complementary to the threading of first adjustment screw 120. However, other dimensions are possible such that first T-nut 148 is configured to be secured within upper T-slot 152 and to receive first adjustment screw 120. An exemplary second T-nut 150 has a total height of 0.25 inches, a maximum width of 0.5 inches, a minimum width of 0.31 inches, and threading complementary to the threading of second adjustment screw 122. However, other dimensions are possible such that second T-nut 150 is configured to be secured within lower T-slot 154 and to receive second adjustment screw 122.

Figure 15:
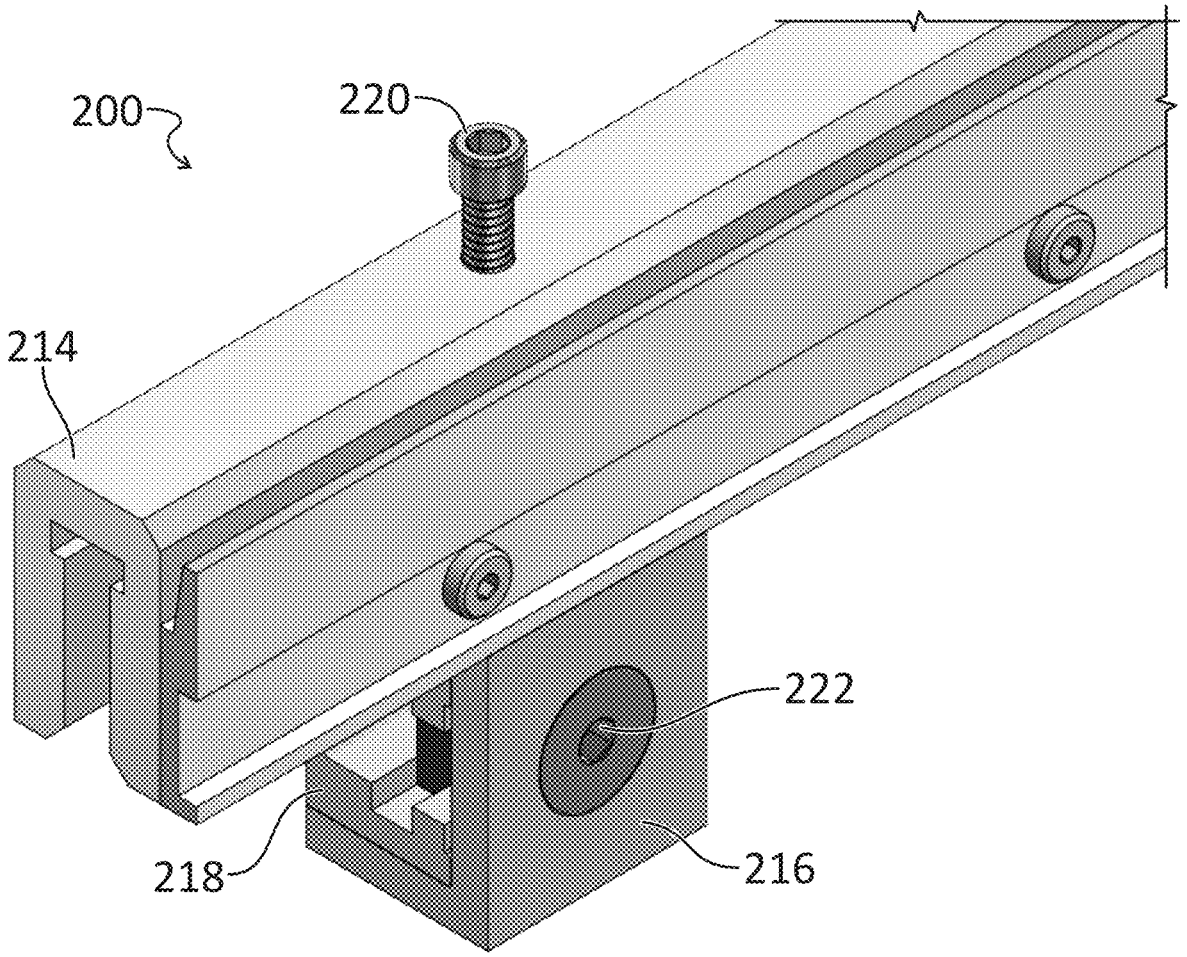
FIG. 15 is a perspective view schematic of a representative clip system of a second embodiment of the present disclosure with three dimensions of adjustability.

Now referring to a second embodiment depicted in FIG. 15, the clip system 200 of the present disclosure is disclosed. Clip system 200 is configured to position and attach finish panels 210 over existing walls 112, similar to the first embodiment system 100. Clip system 200 includes an essentially inverted U-shaped upper portion 214, a middle portion 216, and an essentially C-shaped lower portion 218 that are adjusted to achieve expansion or retraction. Upper portion 214 is moved up and down in a y-direction relative to middle portion 216 using a first or upper adjustment screw 220, as is described for system 100. Middle portion 216 is moved toward or away from lower portion 218 in a z-direction using a second or lower adjustment screw 222, as is likewise described for system 100. One or more lower portion 218 is configured to be attached to existing wall 212 and remains stationary relative to existing wall 212. Upper portion 214 is continuously run horizontally along existing wall 212, while one or more middle portion 216 is installed periodically along upper portion 214 at each lower portion 218. Thus, while FIG. 15 depicts one instance of middle portion 216 installation at one lower portion 218, more than one middle portion 216 and lower portion 218 is compatible with clip system 200. System 200 at least partially spans existing wall 212, though only a representative section of clip system 200 is depicted in FIG. 15.

Figure 16:
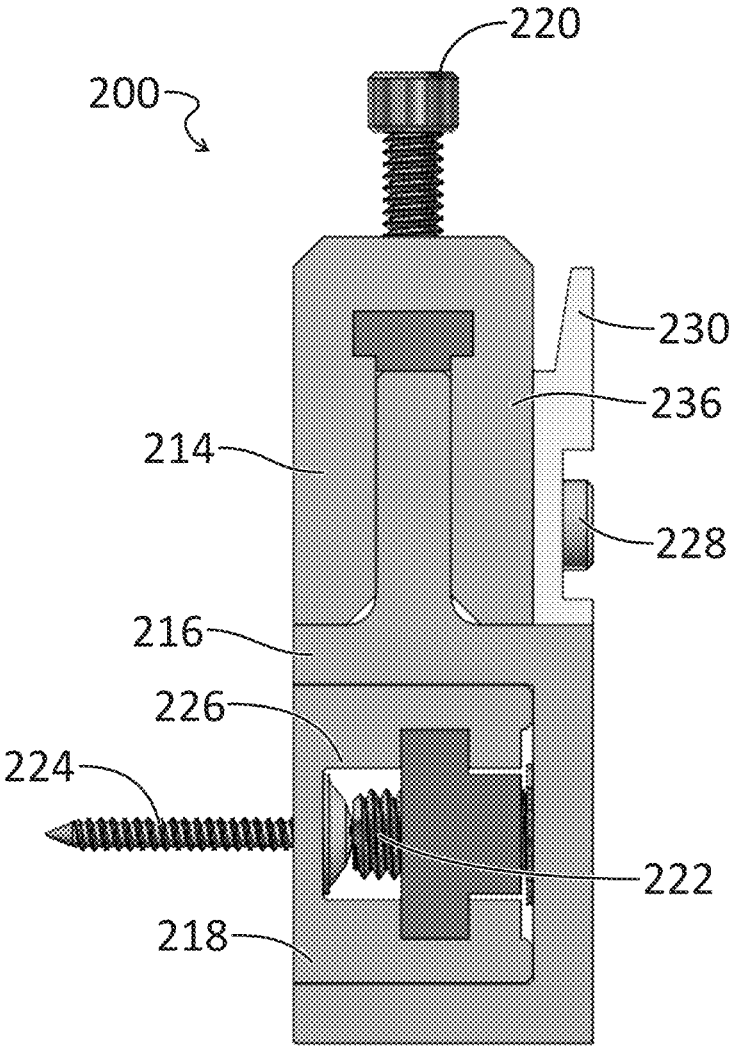
FIG. 16 is a side view schematic of the clip system of FIG. 15 in a retracted configuration.

FIG. 16 shows a side view of clip system 200 in a retracted configuration. In such a situation, both upper portion 214 and middle portion 216 are retracted. Clip system 200 is mounted or attached to existing wall 212 at one or more lower portions 218 using at least one wall fastener 224, as described for system 100. The number of wall fasteners 224 varies based on the number of lower portions 218 required to install finish panel 210. Wall fasteners 224 span openings in a lower portion sidewall 226 and extend outward from clip system 200 and into existing wall 212, when present. Also shown in FIG. 16 is at least one receptacle fastener 228 for fastening receptacle portion 230 to upper portion sidewall 236 of upper portion 214. Receptacle portion 230 is included for receiving an extrusion 232 of panel mount 234, as is described for system 100.

Figure 17:
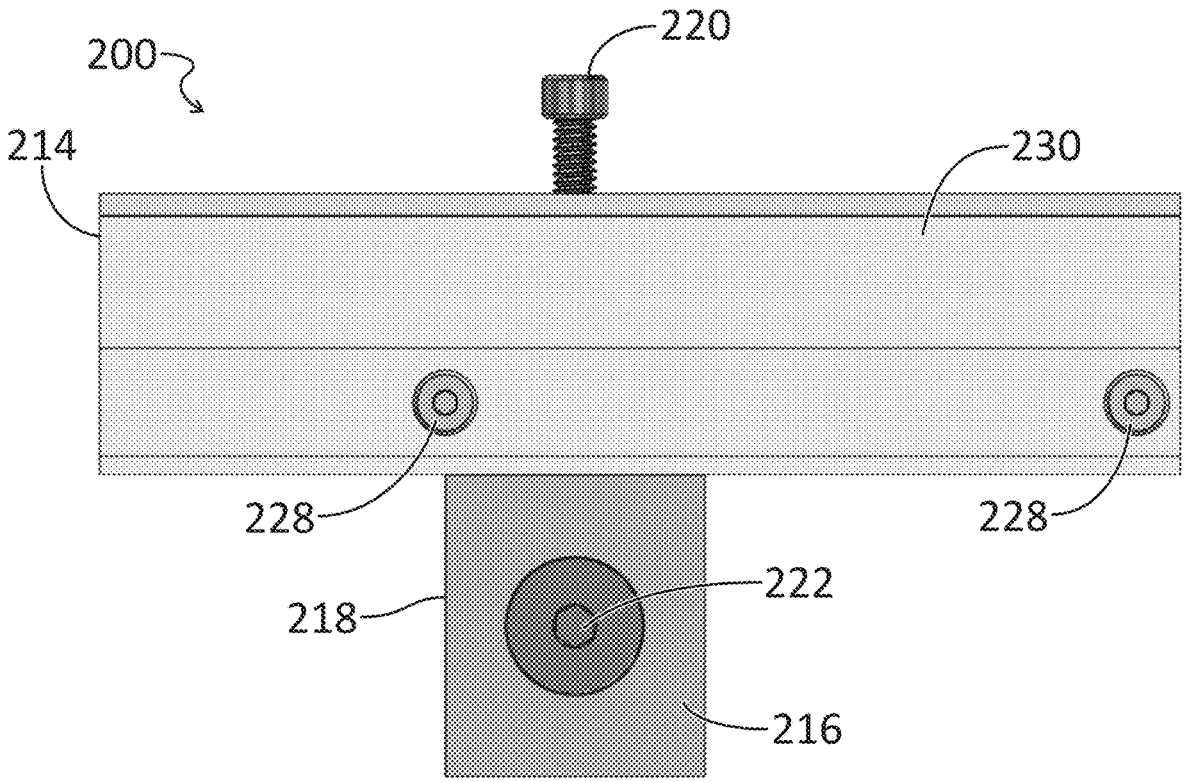
FIG. 17 is a front view schematic of the clip system of FIG. 15 in a retracted configuration.

Referring now to FIG. 17, there is depicted a front view of a representative portion of clip system 200. In this representation, two receptacle fasteners 228 are visible, however other numbers of fasteners are possible, as both upper portion 214 and at least one lower portion 218 are configured to horizontally span portions of existing wall 212 to support finish panel 210. The size of clip system 200 is such that it is mountable on existing wall 212 and configured to support panel mount 234 on finish panel 210. Thus, sizes of clip system vary depending on the application and size of finish panel 210. Similarly, the number and spacing of lower portions 218 and middle portions 216 vary such that finish panel 210 is supported on existing wall 212 using clip system 200. In some instances, more than one clip system 200 is used to position and support several finish panels 210.

Figure 18:
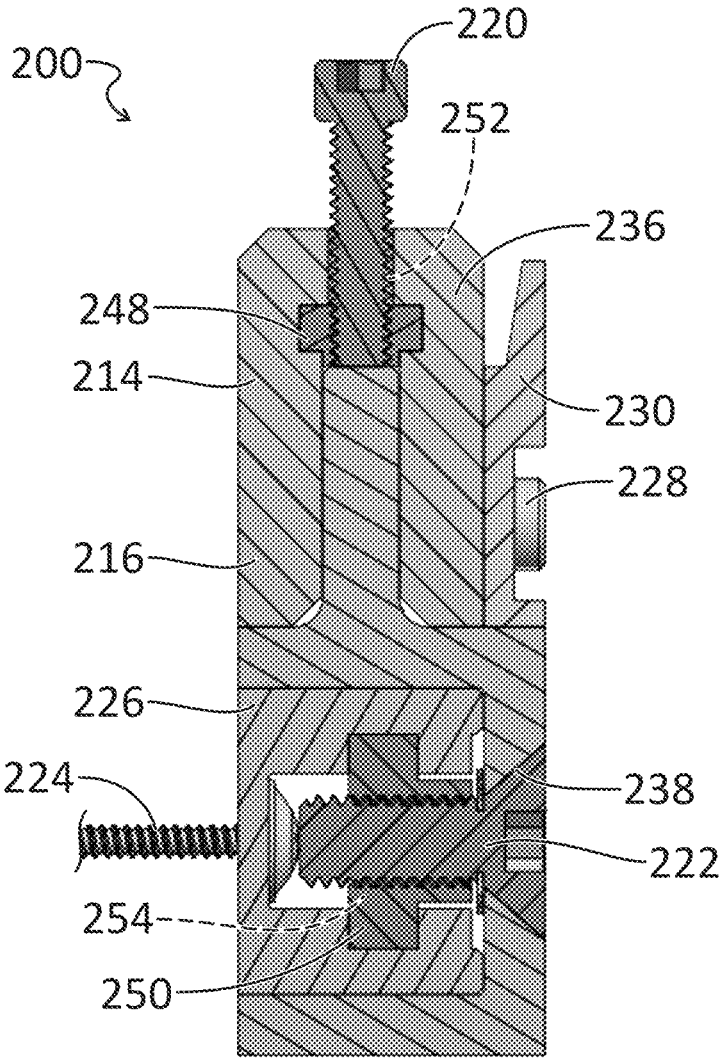
FIG. 18 is a side sectional view schematic of the clip system of FIG. 16.

In FIG. 18, a sectional view of clip system 200 is depicted. While clip system 200 is shown in a retracted configuration, rotation of first adjustment screw 220 increases the distance between upper portion 214 and middle portion 216, effectively increasing the height of clip system 200. Rotation of second adjustment screw 222 increases the distance between middle portion 216 and lower portion 218, effectively increasing the depth of clip system 200. The width of clip system 100 varies, as upper portion 214 and at least one lower portion 218 are configured to horizontally span a portion of existing wall 212 sufficient for the mounting of finish panel 210. Thus, the width of clip system 200 depends at least partially on the size of finish panel 210.

First adjustment screw 220 is threaded to be received in a counterpart first or upper T-nut 248, while second adjustment screw 222 is threaded to be received in counterpart second or lower T-nut 250. The number of first adjustment screws 220, second adjustment screws 222, first T-nuts 248, and second T-nuts 250 vary depending on the number of lower portions 218 and middle portions 216 periodically attached along upper portion 214. Thus, each set of lower portion 218 and middle portion 216 includes one of each: first adjustment screw 220, second adjustment screw 222, first T-nut 248, and second T-nut 250. FIG. 18 depicts an exemplary sectional view of one set of lower portion 218 and middle portion 216 attached to the tracks of upper portion 214, though more than one set of lower portion 218 and middle portion 216 is configured to be attached to upper portion 214. Rotation of first adjustment screw 220 adjusts y-direction clip position and rotation of second adjustment screw 220 adjusts z-direction clip position as described for system 100.

Figure 19:
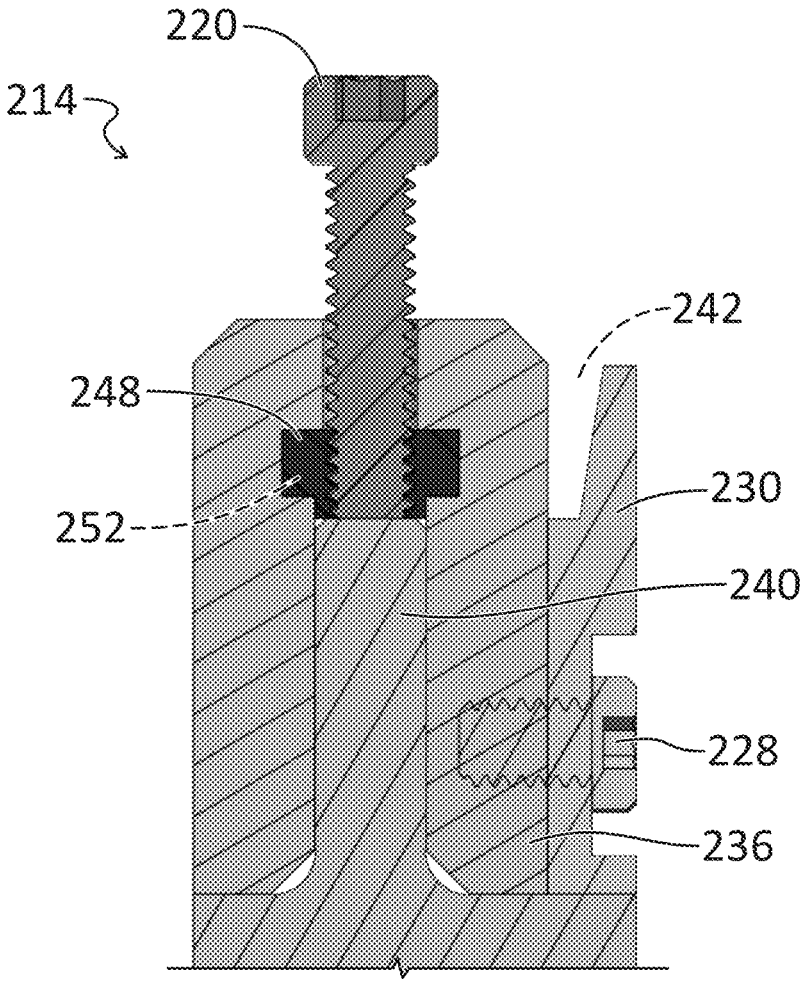
FIG. 19 is a side sectional view schematic of an upper portion the clip system of FIG. 16.

In FIG. 19, a sectional view of upper portion 214 is depicted. Receptacle portion 230 is connected to upper portion 214 as described for system 100. Receptacle portion 230 and upper portion sidewall 236 form an extrusion groove 242 compatible with the stable reception of extrusion 232 of panel mount 234 as described for system 100. Each middle portion 216 is configured to be moveably connected with upper portion 214 through upper extrusion 240, which is configured to reside within upper portion 214. Upper portion 214 moves with respect to each middle portion 216 when each first adjustment screw 220 is rotated. Each first T-nut 248 is housed within an upper T-slot 252 of upper portion 214 and above each upper extrusion 240. Thus, each first T-nut 248 is secured within upper portion 214.

Figure 20:
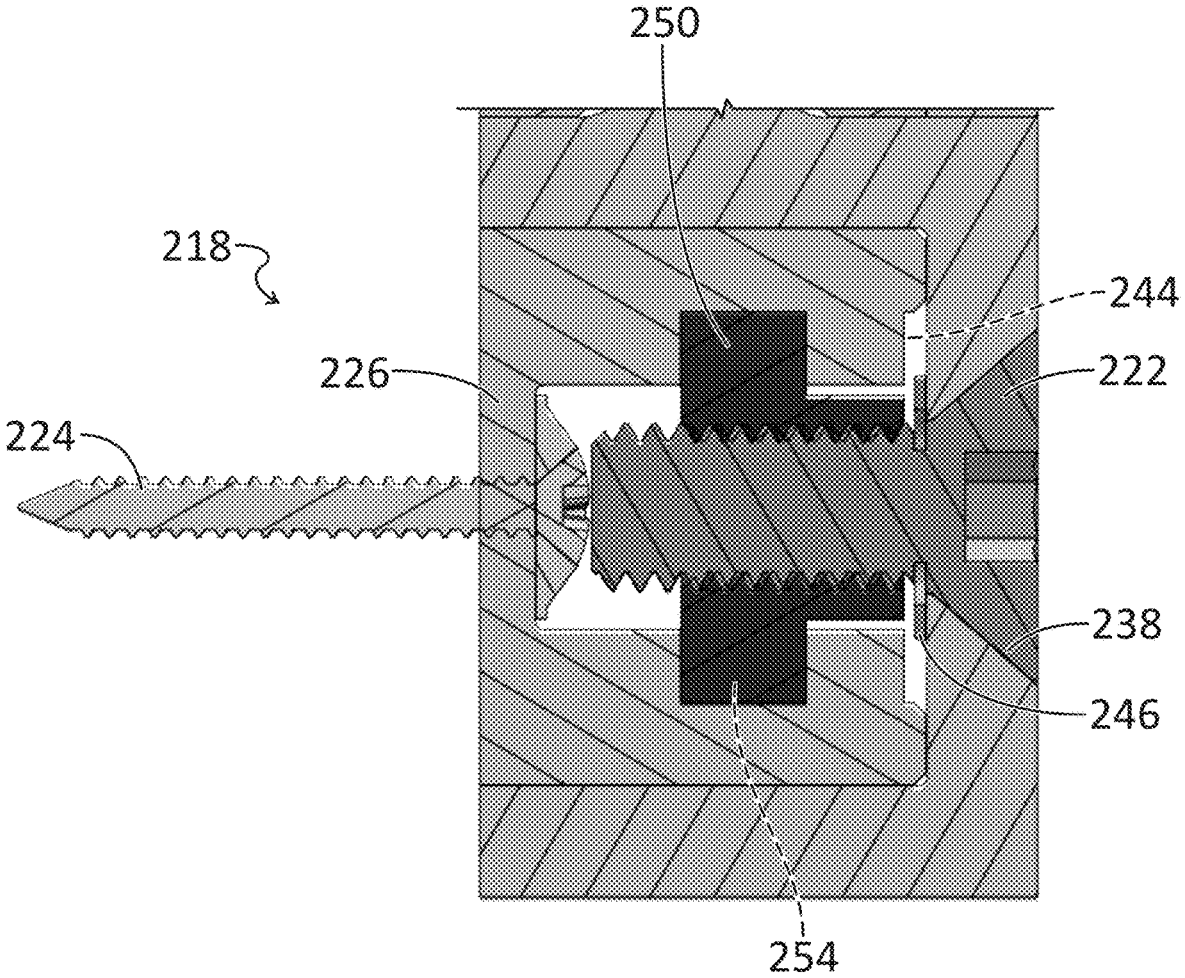
FIG. 20 is a side sectional view schematic of a lower portion the clip system of FIG. 16.

Referring now to FIG. 20, a sectional view of one lower portion 218 is depicted. An attachment groove 244 of each middle portion 216 at least partially surrounds each lower portion 218. This positioning is adjustably secured with each second adjustment screw 222, which extends through an opening in screw head receptacle region 238 of middle portion 216 and into second T-nut 250. When each second attachment screw 222 is rotated, it allows each middle portion 216 (and upper portion 214, when attached to middle portions 216) to move relative to each lower portion 218. Second adjustment screws 222 include an e-clip 246 which snaps into a groove which has been cut into the circumference of each second adjustment screw 222 at a predetermined depth and distance from the screw head. E-clip 246 holds second adjustment screw 222 in position during screw rotation, as is described below. The number of e-clips 246 is such that each second adjustment screw 222 is held into position at screw head receptacle region 238 by one e-clip 246, and thus varies with the number of second adjustment screws 212.

Screw head receptacle region 238 is positioned and sized such that the head of second adjustment screw 222 rests flush with the exterior of middle portion 216. E-clip 246 holds the head of second adjustment screw 222 within screw head receptacle region 238, even when it is rotated. Each second T-nut 250 is configured to receive one second adjustment screw 222 and is housed within a lower T-slot 254 of one lower portion 218. Each second T-nut 250 is secured within one lower portion 218.

Referring now to FIG. 21, there is depicted a dimensional line drawing of a cross section of an exemplary lower portion 218. Lower portion 218 is depicted to have a length of 1.250 inches and a depth of approximately 0.90 inches, though other sizes are possible such that each lower portion 218 is received within attachment groove 244 of one middle portion 216. Lower T-slot 254 is shown to have a length of 0.875 inches and a depth of 0.281 inches, though other dimensions are possible such that each second T-nut 250 is snugly received within lower T-slot 254. An opening of 0.55 inches is provided for portions of each second T-nut 250 and second adjustment screw 222. However, other dimensions of openings are compatible with the present disclosure such that each second T-nut 250 and second adjustment screw 222 fit within.

In FIG. 22, there is depicted a dimensional line drawing of a cross section of an exemplary middle portion 216. Middle portion 216 is depicted to have a length of approximately 2.813 inches and a depth of 1.250 inches, though other sizes are possible. Attachment groove 244 has a length of approximately 1.225 inches, though other lengths are possible such that one lower portion 218 is received within attachment groove 244. Upper extrusion 240 is shown to have a length of 1.063 and a depth of approximately 0.313 inches, though other dimensions are possible such that upper extrusion 240 is received within upper portion 214.

Referring now to FIG. 23, there is depicted a dimensional line drawing of a cross section of upper portion 214. Upper portion 214 is depicted to have a length of 1.625 inches and a depth of 1.00 inches, though other sizes are possible such that each upper extrusion 240 of each middle portion 216 is received within upper portion 214. Upper T-slot 252 is shown to have a length of approximately 0.188 inches and a depth of approximately 0.5 inches, though other dimensions are possible such that each first T-nut 248 is snugly received within upper T-slot 252. An opening of approximately 0.313 inches is provided for portions of each first T-nut 248 and first adjustment screw 220, as well as for reception of each upper extrusion 240. However, other dimensions of openings are compatible with the present disclosure such that each first T-nut 248, first adjustment screw 220, and upper extrusion 240 fit within.

Figure 24:
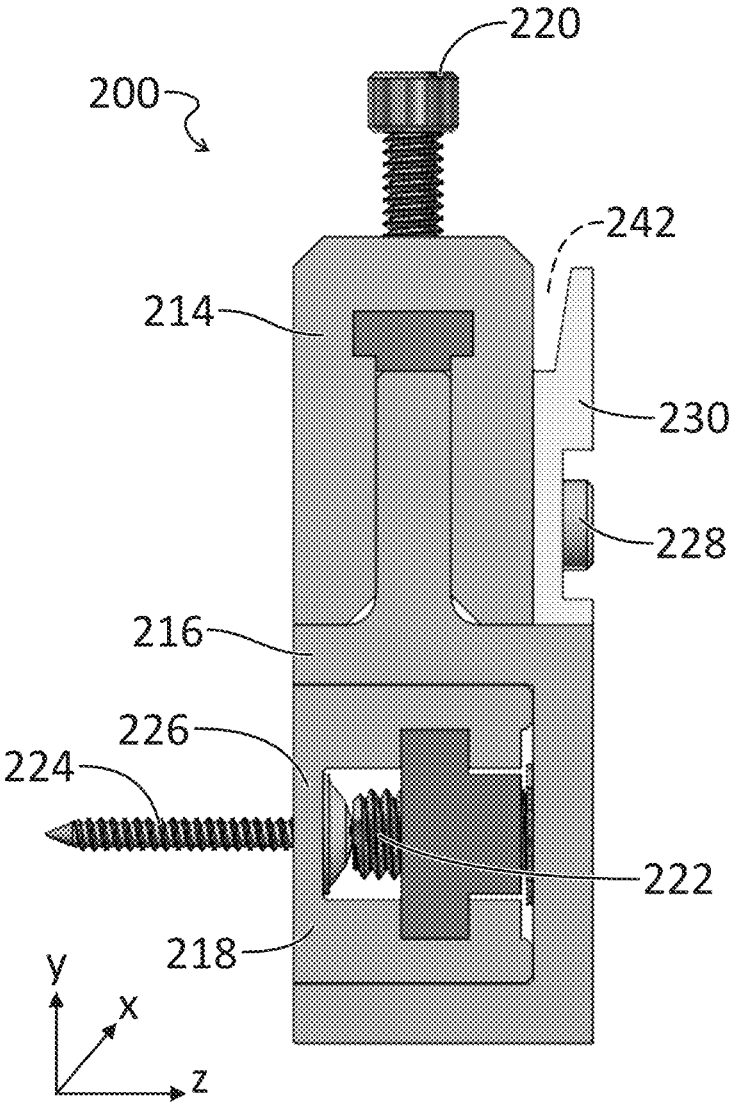
FIG. 24 is a side perspective view schematic of the clip system of FIG. 15 in a retracted configuration.

In FIG. 24, there is depicted an exemplary portion of clip system 200 in a fully retracted configuration. In the exemplary section, one lower portion 218 and middle portion 216 are displayed, though more than one lower portion 218 and middle portion 216 are compatible with the present disclosure. Similarly, upper portion 214 is shown in cross section, though is configured to extend along a desired width of existing wall 212. The mounting is performed by a user who fastens one or more wall fasteners 224 of each lower portion 218 to a steel frame of existing wall 212 using fastening methods and tools known in the art. However, attachment to other wall materials are possible such that clip system 200 is securely installed along existing wall 212 and such that clip system 200 is capable of stably supporting finish panel 210. As one or more lower portions 218, one or more middle portions 216, and upper portion 214 are connected to each other, clip system 200 is mounted when wall fasteners 224 are fastened to existing wall 212. In the fully retracted configuration, first adjustment screws 220 and second adjustment screws 222 are retracted, such that upper portion 214 is not expanded in the y-direction, and one or more middle portions 216 and upper portion 214 are not expanded in the z-direction.

Figure 25:
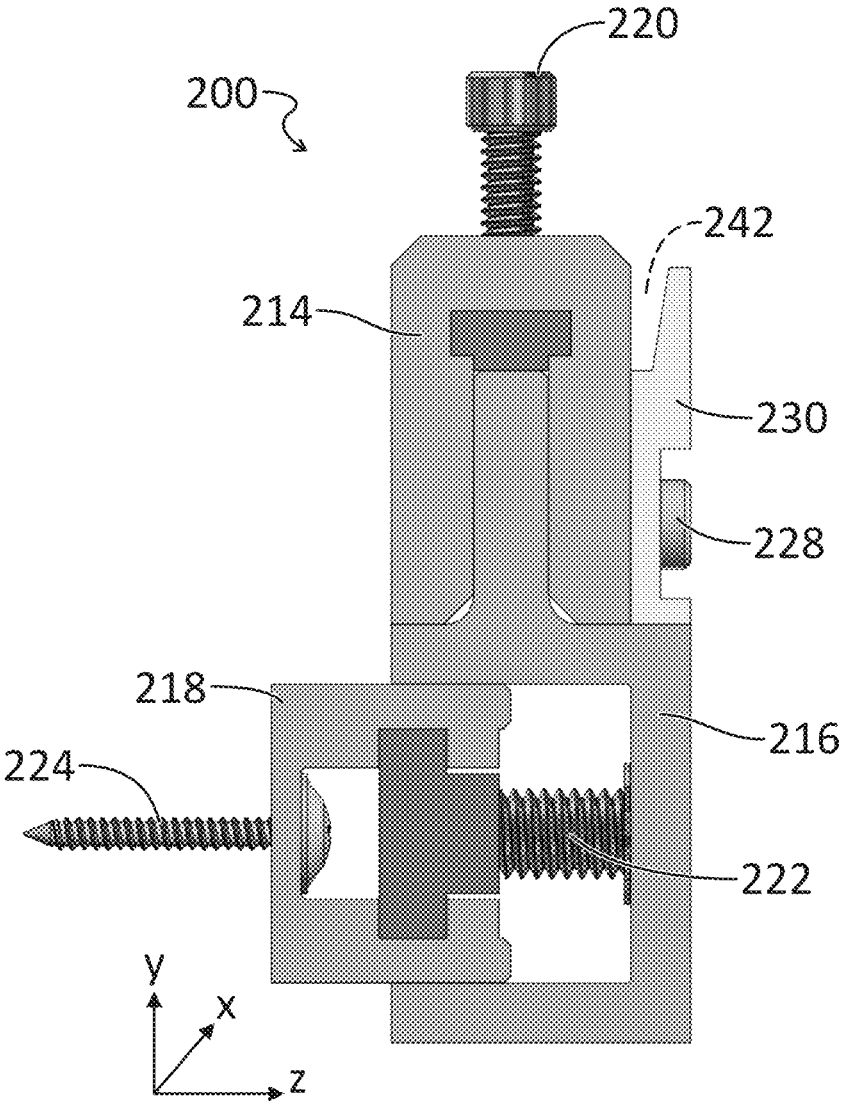
FIG. 25 is a side perspective view schematic of the clip system of FIG. 15 in a partially extended configuration, with extension in a z-direction and retraction in a y-direction.

In FIG. 25, there is depicted an exemplary portion of clip system 200 in a partially expanded configuration. In this case, each middle portion 216 and the attached upper portion 214 are expanded in the z-direction when each second adjustment screw 222 is rotated within its second T-nut 250. Expansion in the z-direction is shown to have a maximum distance of 0.5 expanded inches, though other distances of expansion are possible with different lengths of second adjustment screws 222 and different depth dimensions of middle portions 216 and lower portions 218.

Figure 26:
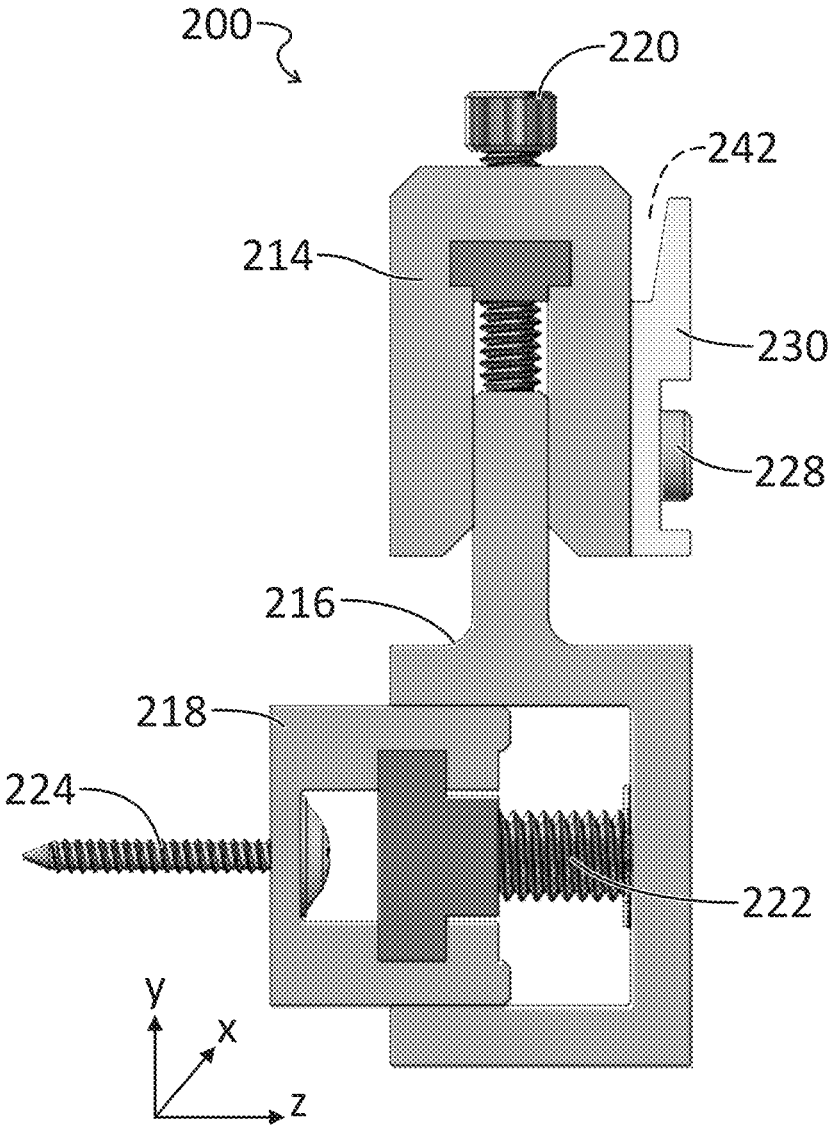
FIG. 26 is a side perspective view schematic of the clip system of FIG. 15 in an extended configuration, with extension in both the z-direction and the y-direction.

Referring now to FIG. 26, there is depicted an exemplary portion of clip system 200 in a fully expanded configuration. In a fully expanded configuration, clip system 200 is fully expanded in both the y-direction and the z-direction. The z-direction expansion is described above in relation to FIG. 25. For the y-direction expansion, upper portion 214 is expanded relative to each middle portion 216 when each first adjustment screw 220 is rotated within its first T-nut 248. Expansion in the y-direction is shown to have a maximum distance of approximately 0.5 expanded inches, though other distances of expansion are possible with different lengths of first adjustment screws 220.

Figure 27:
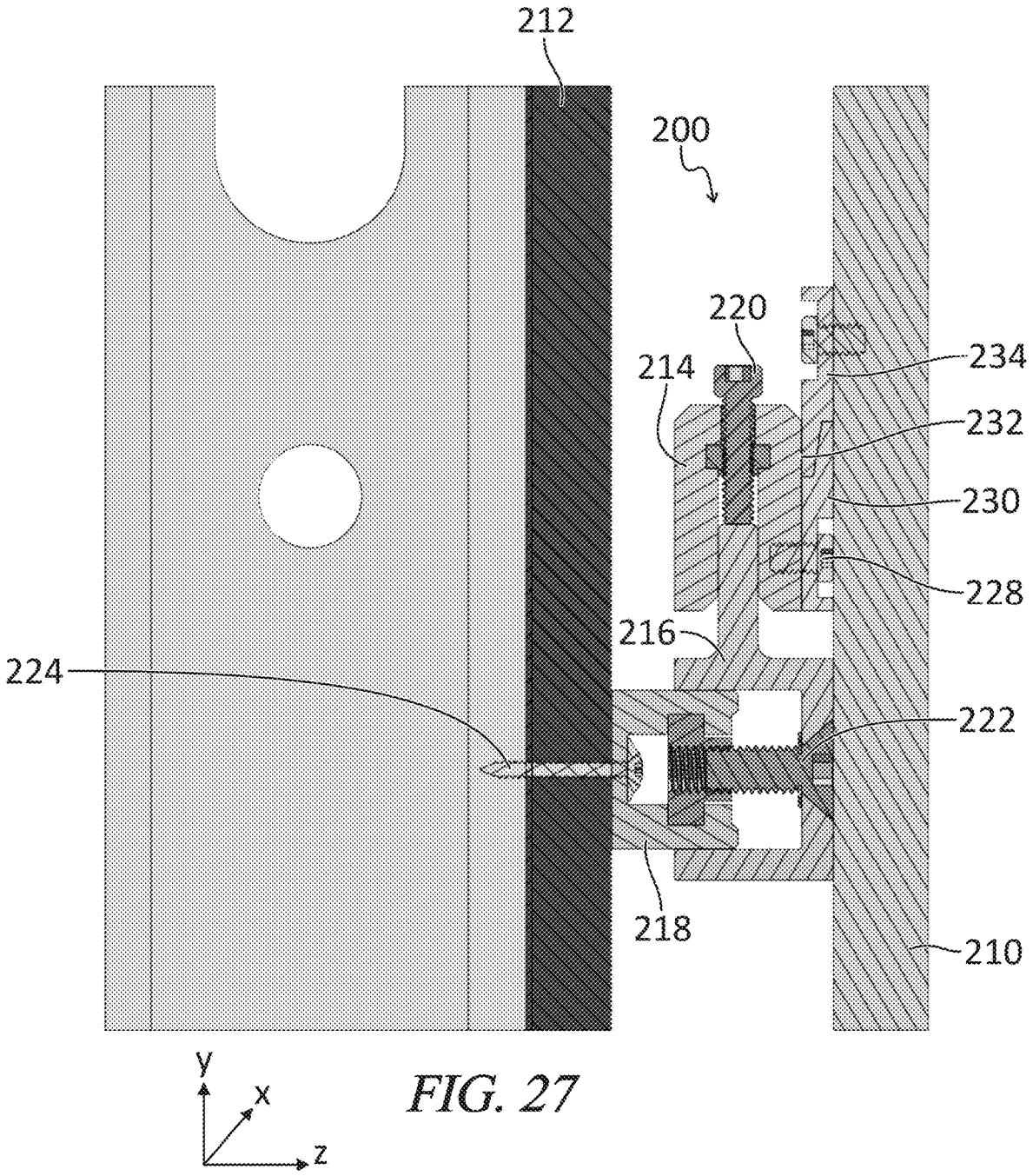
FIG. 27 is a side perspective view schematic of the clip system of FIG. 15 on an existing wall in an extended configuration, with a finish panel attached.

In FIG. 27, a fully expanded clip system 200 is depicted with finish panel 210 attached. Along an existing wall-facing surface of finish panel 210 is attached one or more panel mounts 234. In some instances, one panel mount 234 spans finish panel 210, while in other instances several panel mounts 234 are periodically, horizontally placed along finish panel 210. The location of the one or more panel mount 234 is such that panel mount 234 is configured to fit into complementary receptacle portion 230. More specifically, each extrusion 232 of panel mount 234 is configured to be received within extrusion groove 242 of receptacle portion 230. When mounted, finish panel 210 covers a desired portion of existing wall 212, and thus the locations of mounted clip system 200 on existing wall 212 and panel mount 234 on finish panel 210 are such that the desired coverage is achieved. Clip system 200 provides flexibility in finish panel positioning in the x-direction, as panel mount 234 is configured to slide horizontally within extrusion groove 242. Thus, clip system 200 provides adjustability in x, y, and z-directions. Additionally, finish panel 210 is removable from clip system 200 when extrusion 232 of panel mount 234 is lifted up and out of extrusion groove 242. Thus, finish panels 210 may be removed or exchanged along existing wall 212 without damage to clip system 200 or existing wall 212.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

We claim:

1. A clip system comprising:

an inverted U-shaped upper portion having an upper T-slot for housing at least one upper T-nut;

at least one upper adjustment screw, each upper adjustment screw configured to extend through a top of the upper portion and into one upper T-nut;

a receptacle portion for coupling to an exterior face of the upper portion, the receptacle portion and upper portion forming an extrusion groove;

at least one C-shaped lower portion configured to be coupled to a wall structure, each lower portion having a lower T-slot for housing at least one lower T-nut;

at least one middle portion configured to connect the upper portion with one of the at least one lower portions, each middle portion having an upper extrusion configured to be received within the upper T-slot and below one upper T-nut of the upper portion, an attachment groove configured to receive one lower portion, and a screw head receptacle region located on an exterior side of the middle portion; and at least one lower adjustment screw, each lower adjustment screw configured to extend into one lower T-nut of one lower portion with its screw head secured within one screw head receptacle region of one middle portion, such that, when the clip system is assembled, rotation of the at least one upper adjustment screw moves the upper portion relative to the at least one middle portion in a first axial direction, rotation of the lower adjustment screw moves the at least one middle portion and upper portion relative to the at least one lower portion in a second axial direction, and a panel mount attached to a finish panel is configured to be received and moved in a third axial direction within the extrusion groove.

2. The clip system of claim 1, wherein the at least one lower portion is configured to continuously and horizontally span a section of the wall structure in which at least one finish panel is intended to cover.

3. The clip system of claim 2, wherein the upper portion is configured to run continuously and parallel to the at least one lower portion, and wherein the at least one middle portion is configured to support the upper portion above the at least one lower portion.

4. The clip system of claim 1, wherein the receptacle portion is configured to be coupled to the upper portion using one or more receptacle fasteners.

5. The clip system of claim 1, wherein the at least one lower portion is configured to be coupled to the wall structure using one or more wall fasteners.

6. The clip system of claim 1, wherein the panel mount includes a panel extrusion that is complementary to the extrusion groove for receiving the panel mount within the extrusion groove.

7. The clip system of claim 1, wherein rotation of the at least one upper adjustment screw moves the upper portion relative to the at least one middle portion up to 0.5 inches in the first axial direction.

8. The clip system of claim 1, wherein rotation of the at least one lower adjustment screw moves the at least one middle portion and upper portion relative to the at least one lower portion up to 0.5 inches in the second axial direction.

9. The clip system of claim 1, wherein each screw head receptacle region includes an access slider for securing a screw head within the screw head receptacle region.

10. The clip system of claim 1, wherein the at least one lower adjustment screw includes an e-clip in a clip groove beneath its screw head for securing its screw head within the screw head receptacle region.

11. A method of attaching a finish panel to a modular wall, the method comprising:

fastening a clip system to the modular wall, the clip system including:

an inverted U-shaped upper portion having an upper T-slot housing at least one upper T-nut, at least one upper adjustment screw, each upper adjustment screw extending through a top of the upper portion and into one upper T-nut, a receptacle portion coupled to an exterior face of the upper portion, the receptacle portion and upper portion forming an extrusion groove, at least one C-shaped lower portion having a lower T-slot housing at least one lower T-nut, at least one middle portion connecting the upper portion with the at least one lower portion, each middle portion having an upper extrusion received within the upper T-slot and below one upper T-nut of the upper portion, an attachment groove receiving the one lower portion, and a screw head receptacle region located on an exterior side of the middle portion, and at least one lower adjustment screw, each lower adjustment screw extending into one lower T-nut of one lower portion with its screw head secured within one screw head receptacle region of one middle portion;

rotating the at least one upper adjustment screw to move the upper portion relative to the at least one middle portion in a first axial direction, such that the clip system is placed a predetermined first axial position for finish panel placement;

rotating the at least one lower adjustment screw to move the at least one middle portion and upper portion relative to the at least one lower portion in a second axial direction, such that the clip system is placed a predetermined second axial position for finish panel placement;

coupling a panel mount to the finish panel, the panel mount having a panel extrusion configured to be received within the extrusion groove of the receptacle portion of the clip system; and placing the panel mount of the finish panel within the extrusion groove of the clip system, such that the finish panel is attached to the modular wall by reception of the panel mount within the clip system.

12. The method of claim 11, wherein at least one wall fastener is passed through the at least one lower portion and into the modular wall for fastening the clip to the modular wall.

13. The method of claim 11, further including the step of moving the panel mount within the extrusion groove in a third axial direction, such that the finish panel is placed in a predetermined third axial position for finish panel placement.

14. The method of claim 11, wherein the at least one lower portion continuously and horizontally spans a section of the modular wall in which at least one finish panel is intended to cover.

15. The method of claim 14, wherein the upper portion runs continuously and parallel to the at least one lower portion, and wherein the at least one middle portion supports the upper portion above the at least one lower portion.

16. The method of claim 11, wherein the receptacle portion is coupled to the upper portion using one or more receptacle fasteners.

17. The method of claim 11, wherein rotating the at least one upper adjustment screw moves the upper portion relative to the at least one middle portion up to 0.5 inches in the first axial direction.

18. The method of claim 11, wherein rotating the at least one lower adjustment screw moves the at least one middle portion and upper portion relative to the at least one lower portion up to 0.5 inches in the second axial direction.

19. The method of claim 11, wherein each screw head receptacle region includes an access slider that secures a screw head within the screw head receptacle region.

20. The method of claim 11, wherein the at least one lower adjustment screw includes an e-clip in a clip groove beneath its screw head for securing its screw head within the screw head receptacle region.

* * * * *